US011596225B1

(12) United States Patent
Sherman et al.

(10) Patent No.: US 11,596,225 B1
(45) Date of Patent: Mar. 7, 2023

(54) CONVERTIBLE FURNITURE ARTICLE

(71) Applicant: Inova LLC, Guilderland Center, NY (US)

(72) Inventors: Loren Sherman, Oro Valley, AZ (US); Alexander Roumanidakis, Albany, NY (US)

(73) Assignee: INOVA LLC, Guilderland Center, NY (US)

( * ) Notice: Subject to any disclaimer, the term of this patent is extended or adjusted under 35 U.S.C. 154(b) by 0 days.

(21) Appl. No.: 17/456,277

(22) Filed: Nov. 23, 2021

Related U.S. Application Data

(60) Provisional application No. 63/251,122, filed on Oct. 1, 2021.

(51) Int. Cl.

| | |
|---|---|
| ***A47B 43/00*** | (2006.01) |
| ***A47B 1/05*** | (2006.01) |
| ***A47B 3/10*** | (2006.01) |
| ***A47B 45/00*** | (2006.01) |
| ***A47B 46/00*** | (2006.01) |
| ***A47B 9/04*** | (2006.01) |

(52) U.S. Cl.
CPC ..... *A47B 43/00* (2013.01); *A47B 1/05* (2013.01); *A47B 3/10* (2013.01); *A47B 9/04* (2013.01); *A47B 45/00* (2013.01); *A47B 46/00* (2013.01); *A47B 2200/004* (2013.01)

(58) Field of Classification Search
CPC .. A47B 43/00; A47B 1/05; A47B 3/10; A47B 9/04; A47B 45/00; A47B 46/00; A47B 2200/004
See application file for complete search history.

(56) References Cited

U.S. PATENT DOCUMENTS

| | | | | | |
|---|---|---|---|---|---|
| 1,888,176 | A * | 11/1932 | Latshaw | B61F 5/302 | 105/213 |
| 4,436,353 | A * | 3/1984 | Tucker | A45F 4/00 | 312/258 |
| 4,572,081 | A * | 2/1986 | Copeland | A47B 1/03 | 108/177 |
| 4,893,885 | A | 1/1990 | Borello | | |
| 6,925,944 | B1 * | 8/2005 | Miller | A47B 3/00 | 108/115 |
| 8,100,062 | B1 | 1/2012 | Anghel | | |
| 9,222,255 | B2 * | 12/2015 | Johnson | E04B 1/343 | |
| 2002/0171342 | A1 | 11/2002 | Bristow | | |
| 2007/0289505 | A1 * | 12/2007 | Turenne | A47B 1/05 | 108/73 |

(Continued)

FOREIGN PATENT DOCUMENTS

| | | | | |
|---|---|---|---|---|
| GB | 2577507 A | * | 4/2020 | A47B 1/04 |
| JP | 2013022178 A | | 2/2013 | |

*Primary Examiner* — Daniel J Rohrhoff
(74) *Attorney, Agent, or Firm* — Hoffman Warnick LLC

(57) ABSTRACT

A convertible furniture article includes a cabinet assembly; a countertop assembly, the countertop assembly attached to the cabinet assembly; a female wing; a male wing; wherein each of the female wing and the male wing are pivotally attached to the countertop assembly; and a rotatable linkage and pivot assembly connected to the countertop assembly and the cabinet assembly. The rotatable linkage and pivot assembly being configured to permit rotation of the countertop assembly approximately 90 degrees from a first position to a second position.

20 Claims, 23 Drawing Sheets

(56) References Cited

U.S. PATENT DOCUMENTS

| | | | | |
|---|---|---|---|---|
| 2012/0025681 | A1* | 2/2012 | Ton | A47B 46/00<br>312/309 |
| 2014/0132129 | A1* | 5/2014 | Deneweth | A47B 77/04<br>312/249.8 |

* cited by examiner

CONVERTIBLE FURNITURE ARTICLE

TECHNICAL FIELD

This non-provisional patent application claims priority from and the benefit of the filing date of earlier-filed Provisional Application 63/251,122 filed on Oct. 1, 2021 entitled CONVERTIBLE FURNITURE ARTICLE. The entire content of earlier-filed Provisional Application 63/251,122 filed on Oct. 1, 2021 is incorporated herein by reference for all purposes.

The disclosure relates generally to convertible furniture. In particular, the disclosure relates to a convertible furniture article that converts from a counter to a table.

BACKGROUND

Cities are becoming more populous. Apartment, condominium, co-op, and housing space in general is getting tighter and tighter, and in many circumstances smaller and smaller. Space can be relatively expensive be due to the basic costs of the location and size of the housing space. In addition to these costs, people may incur further expense configuring the housing space in a desirable layout. A person might purchase or rent a housing space in a building, and then subdivide or partition the housing space into various rooms, spaces, offices, for themselves and/or others living in the space, for example, roommates or family. Rather than having to find new housing space and move as needs change, it is often desirable to reengineer and adapt the existing housing space to accommodate enhanced uses. Further, developer may want to construct buildings with spaces that are as efficient as possible, while still being as practical and comfortable as possible.

While reconfiguring space is a solution to make space more useable, converting furniture for multiple uses in a housing may be beneficial. Convertible furniture is commonly utilized as a space saving expedient, for example, in living quarters having limited space, such as in studios and in small apartments that are frequently found in densely populated urban areas. A typical non-limiting illustration of such convertible furniture is the conventional sofa-bed, which provides a sofa in one mode and a bed frame and mattress in another mode.

BRIEF DESCRIPTION

All aspects, examples and features mentioned below can be combined in any technically possible way.

An aspect of the disclosure provides a convertible furniture article including a cabinet assembly; a countertop assembly, the countertop assembly attached to the cabinet assembly; a female wing; a male wing; wherein each of the female wing and the male wing are pivotally attached to the countertop assembly; and a rotatable linkage and pivot assembly connected to the countertop assembly and the cabinet assembly. The rotatable linkage and pivot assembly being configured to permit rotation of the countertop assembly approximately 90 degrees from a first position to a second position.

Another aspect of the disclosure includes any of the preceding aspects, and the countertop assembly and the cabinet assembly each include a first axis and a second axis, the first axis being longer than the second axis, wherein when the first axis of the countertop assembly and the cabinet assembly are aligned, the convertible furniture article is in the first position, and when the countertop assembly and the cabinet assembly are pivoted 90 degrees about the rotatable linkage and pivot assembly the convertible furniture article is in the second position.

Another aspect of the disclosure includes any of the preceding aspects, and wherein the first position is configured to present an island position and the second position is configured to present a table position.

Another aspect of the disclosure includes any of the preceding aspects, and the convertible furniture article includes at least one pullout assembly at a side of the cabinet assembly.

Another aspect of the disclosure includes any of the preceding aspects, and wherein the at least one pullout assembly includes at least one shelf.

Another aspect of the disclosure includes any of the preceding aspects, and the countertop assembly including at least one countertop extension, the at least one countertop extension nested in the countertop assembly.

Another aspect of the disclosure includes any of the preceding aspects, and wherein the at least one countertop extension nested in the countertop assembly includes two countertop extensions nested in the countertop assembly, each countertop extension nested in the countertop assembly configured to be slidably extendable from the countertop assembly.

Another aspect of the disclosure includes any of the preceding aspects, and the convertible furniture article includes at least one pullout assembly at a side of the cabinet assembly, wherein the at least one pullout assembly is configured to support the at least one countertop extension when the at least one countertop extension is in an extended position.

Another aspect of the disclosure includes any of the preceding aspects, and the convertible furniture article includes two pullout assemblies at each side of the cabinet assembly and two countertop extensions with one at each side of the cabinet assembly, each of the two pullout assemblies includes at least one shelf, wherein each of the two pullout assemblies is configured to support a respective one of the countertop extensions when the respective countertop extension is in an extended position.

Another aspect of the disclosure includes any of the preceding aspects, and each of the at least one pullout assembly includes at least one shelf and an extension support pivotally mounted to the at least one shelf, wherein the extension support is pivoted from a position on top of the at least one shelf to a position orthogonal to the at least one shelf, wherein the at least one countertop extension when in an extended position is configured to be supported by the extension support of the pullout assembly.

Another aspect of the disclosure includes any of the preceding aspects, and further including a wing extension system including a rack and pinion gear system, the rack and pinion gear system mounted to a bottom of the countertop assembly, the female wing and the male wing pivotally connected to the rack and pinion gear system, wherein each of the female wing and the male wing are configured to be pivoted upwards and alignable with the countertop assembly.

Another aspect of the disclosure includes any of the preceding aspects, and the rack and pinion gear system including at least one geared rack engaged with a geared pinion, each of the female wing and the male wing pivotally connected to one of the at least one geared rack, wherein pivotal movement of one of female wing and the male wing moves the geared rack, and movement of the geared rack rotates the geared pinion.

Another aspect of the disclosure includes any of the preceding aspects, and the rack and pinion gear system including two sets of two geared racks engaged with a geared pinion, an inner set of geared racks pivotally attached to the male wing and an outer set of geared racks pivotally attached to the female wing, wherein pivotal movement of one of the female wing and the male wing will automatically cause pivotal motion of the other of the female wing and the male wing.

Another aspect of the disclosure includes any of the preceding aspects, and the rotatable linkage and pivot assembly further including a pivot rod connected to the bottom of the countertop assembly.

Another aspect of the disclosure includes any of the preceding aspects, and the rotatable linkage and pivot assembly further including a pivot rod connected to the bottom of the countertop assembly, wherein pivoting of one of the female wing and the male wing will lower the countertop assembly towards the cabinet assembly with the pivot rod moving into the cabinet assembly.

Another aspect of the disclosure includes any of the preceding aspects, and the rotatable linkage and pivot assembly further including a cut out in the cabinet assembly and a pivot plate attached to the countertop assembly, the pivot plate configured to move within the cut out in the cabinet assembly.

Another aspect of the disclosure includes any of the preceding aspects, and the rotatable linkage and pivot assembly further including a stopper mounted on the cut out, and a slot formed in the pivot plate, the stopper configured to be disposed in the slot and moveable only therein, whereby movement of the countertop assembly is limited by interaction of the slot and stopper.

Another aspect of the disclosure includes any of the preceding aspects, and further including at least one drawer mounted within at least one of the female wing and the male wing.

Another aspect of the disclosure includes any of the preceding aspects, and further including wheels disposed on the cabinet assembly.

Another aspect of the disclosure includes any of the preceding aspects, and wherein the female wing includes a cutout, the cutout configured to allow access to the cabinet assembly when the female wing is in a lowered position.

Two or more aspects described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
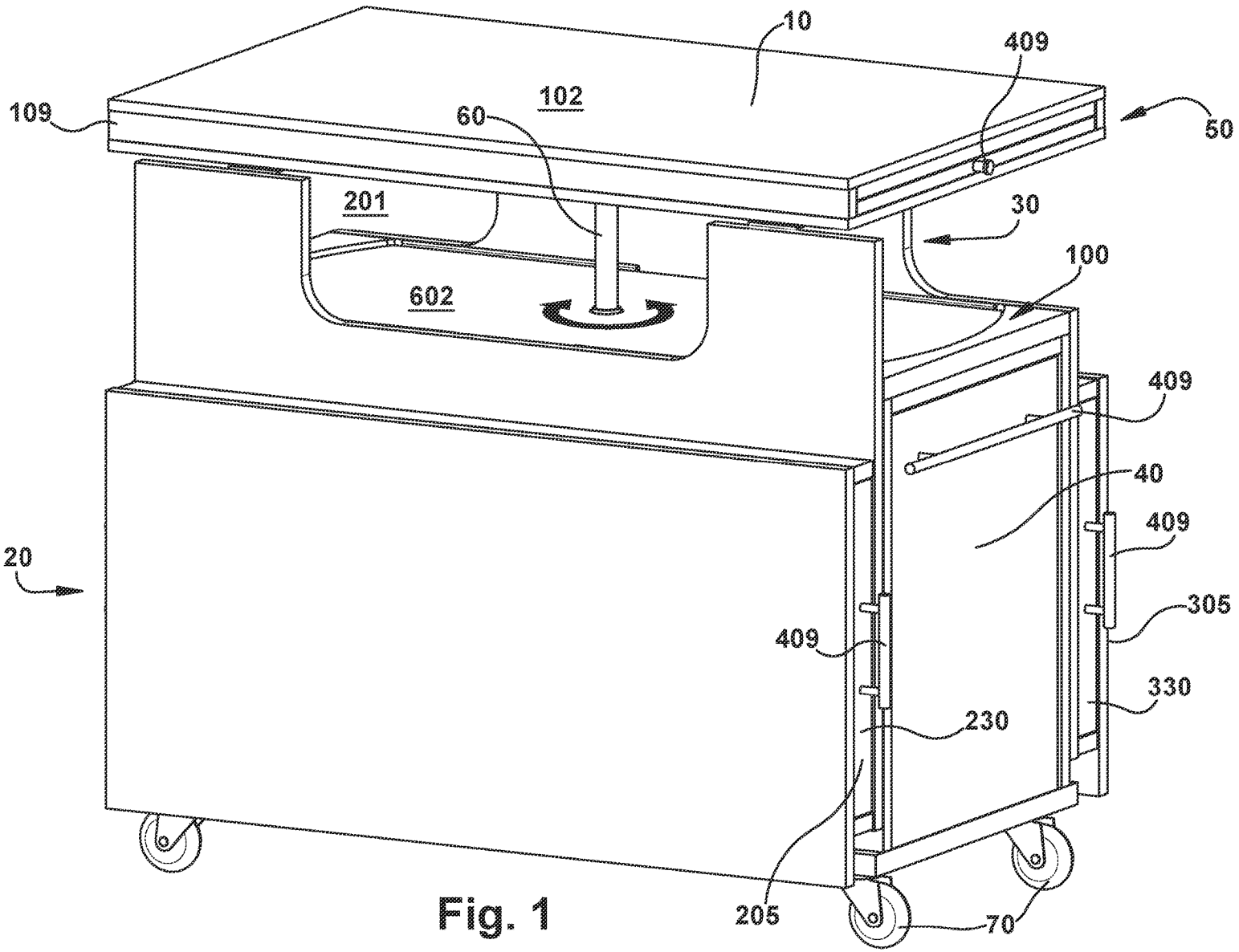
FIG. 1 illustrates a side perspective view of a furniture unit that converts from a counter to a table in the closed island position according to embodiments of the disclosure.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the subject matter of the current disclosure, it will become necessary to select certain terminology when referring to and describing relevant components within furniture, including but not limited to convertible furniture. To the extent possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, as described below. The terms "first", "second", and "third" may be used interchangeably to distinguish one component from another and are not intended to signify location or importance of the individual components.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components but do not preclude the presence or addition of one or more other features, integers, steps, operations, elements, components, and/or groups thereof. "Optional" or "optionally" means that the subsequently described event or circumstance may or may not occur or that the subsequently describe component or element may or may not be present, and that the description includes instances where the event occurs or the component is present and instances where it does not or is not present.

Where an element or layer is referred to as being "on," "engaged to," "connected to" or "coupled to" another element or layer, it may be directly on, engaged to, connected to, or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

In addition, several descriptive terms may be used regularly herein, and it should prove helpful to define these terms at the onset of this section. These terms and their definitions, unless stated otherwise, are as follows. As used herein, "vertical" and "horizontal" are terms that indicate a direction relative to the figures herein. The terms "above" and "below" are used with reference to orientations of elements with respect to each other relative to the figures herein. The terms "left" and "right" are used with reference to orientations of elements in the figures with respect to each other also relative to the figures herein.

In accordance with aspects of the environment, the figures illustrate a convertible furniture article or unit that converts them a counter or island position to a table position. With reference to the figures, FIG. 1 illustrates the furniture unit in a closed island position. Convertible furniture unit 1 includes a countertop assembly 10, a female wing 20, and a male wing 30.

Countertop assembly 10, female wing 20, and male wing 30 are attached to cabinet assembly 100. Cabinet assembly 100 includes a pullout assembly 40, a counter extension system 50, a rotatable linkage and pivot assembly 60 (hereinafter pivot assembly 60), and wheels 70 for moving convertible furniture unit 1. As embodied by the disclosure, wheels 70 enable free 360° movement of convertible furniture unit 1. Also, convertible furniture unit 1 can include wheels 70 with locks to prevent further movement and positioning of convertible furniture unit 1 when the convertible furniture unit 1 is in the desired position and location in the living area.

Each of female wing unit 20 and male wing unit 30 are pivotally attached to countertop assembly 10. Moreover, female wing assembly 20 includes a cut out 201, which allows for access to an interior of convertible furniture unit 1 when convertible furniture unit 1 is in the closed island position as in FIG. 1.

Figure 2:
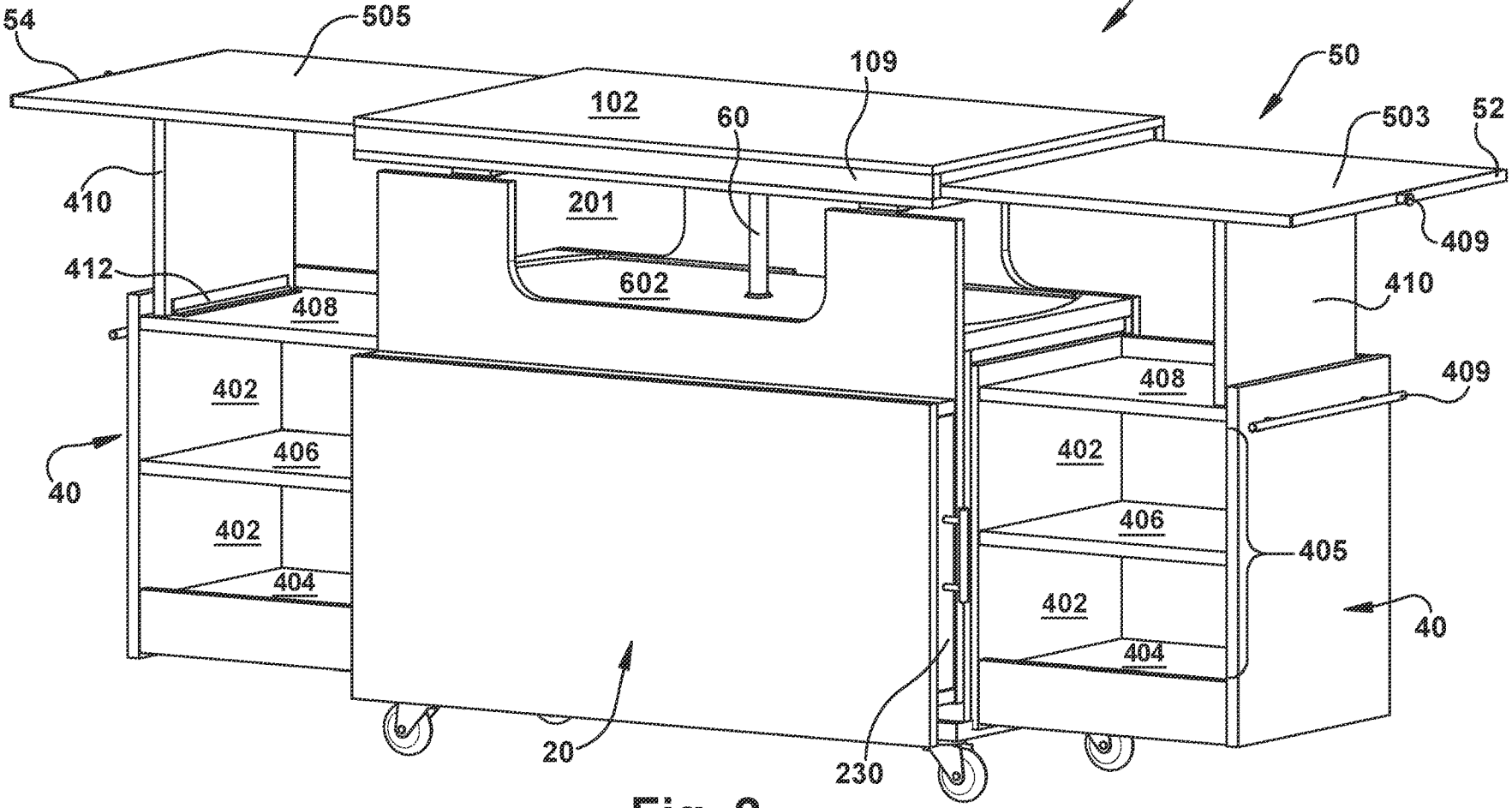
FIG. 2 illustrates a side perspective view of a furniture unit that converts from a counter to a table in the extended island position according to embodiments of the disclosure.
Figure 3:
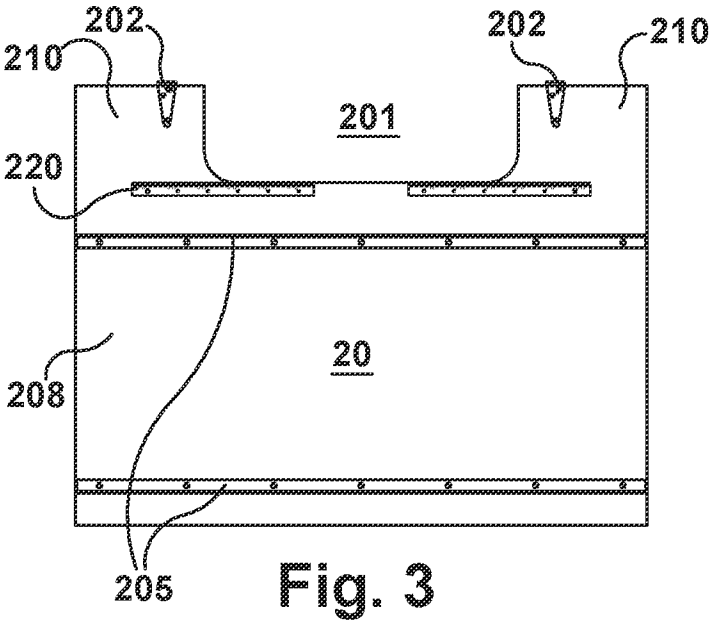
FIG. 3 is a schematic illustration of a female wing of a furniture unit that converts from a counter to a table in the table or desk position according to embodiments of the disclosure.

Further, pull out unit 40, which is illustrated in FIG. 2, includes a handle 409 to extend the pullout unit for access to storage shelves, which will be described hereinafter. Additionally, in another aspect of the embodiment, female wing unit 20 and male wing unit 30 may also include custom drawer spaces, 210 and 310 respectively, as seen in FIG. 3.

Noting FIGS. 1 and 2, countertop assembly 10 includes a countertop surface 102. Countertop extension system 50 includes an upper countertop extension 52 and a lower countertop extension 54, best seen in FIG. 2. Upper countertop extension 52 and lower countertop extension 54 are nested in countertop assembly 10. In an aspect of the embodiments, upper countertop extension 52 includes an upper countertop extension countertop 503 while lower countertop extension 54 includes a lower countertop extension countertop 505. In another aspect of the embodiments, upper countertop extension 52 and lower countertop extension 54 are nested and configured to be slidably moved in and out of countertop assembly 10. A length of each extension can be the entire length of countertop assembly 10, the extensions on two different overlapping planes. In a further aspect of the embodiments, each extension can be about half of the length of the countertop assembly 10, with both extensions in the same plane.

A pullout assembly 40 is provided on each end of convertible furniture unit 1, as shown in FIG. 2. With reference to FIGS. 1, 2, 3-7, and 8-10, convertible furniture unit 1 in the island configuration (FIGS. 1 and 3-7) and an extended island configuration (FIGS. 2 and 8-10) will be described.

Each pull out assembly 40 includes shelves 404, 406, and 408. Shelves 404 and 408 are stationary, while shell 406 maybe adjustable to vary heights of a shelf space 402 defined between shelves 404 and 406 and between shelves 406 and 408 respectively. Each pull out assembly 40 may ride on a draw slide of any nature (not shown) to allow pull out assemblies 40 to easily move in and out of the base or cabinet 110. With reference to FIG. 2, pull out assembly 40 also includes an extension support 410. Extension support 410 is connected to upper side of shelf 408 through a hinge 412. In the stored position of pullout assembly 40, extension support 410 is pivoted onto shelf 408 and lies on top of shelf 408, thereby letting pull out unit 40 to be fully inserted into cabinet 110. As will be described hereinafter with respect to counter extension system 50, extension support 410 can be pivoted about hinge 412 to an orthogonal position with respect to shelf 408.

FIG. 2 illustrates one hinge 412 per extension support 410 where extension support 410 is connected to shelf 408. However, hinges 412 can be provided on either side of each extension support 410. Moreover, hinge 412 on one or the other side of extension support 410 can be provided as multiple hinges. Accordingly, as embodied by the disclosure, extension support 410 can include multiple hinges 412 on one side of extension support 410. Further, as embodied by the disclosure, hinge 412 can be configured to include a stop that limits rotation of extension support 410 to an essentially perpendicular orientation to shelf 408. Thus, with a stop (not illustrated for ease of understanding) on extension support 410, extension support 410 is "upright" to provide stable, balanced, and even positioning of upper counter extension 52 and upper counter extension 54 when extended.

Convertible furniture unit 1 can be used in the closed island position as illustrated in FIG. 1 as a countertop or island. To provide for further and enhanced space on countertop surface 102, countertop extension system 50 can extend the countertop surface 102. Upper and lower countertop extension countertops 503 and 505 provide for extend the countertop surface 102 for the convertible furniture unit 1.

Counter extension system 50 includes the upper counter extension 52, which as illustrated in FIG. 2, can be extended out of countertop extension system 50 to one side alone, as needed. Moreover, countertop extension system 50 can have the lower countertop extension 54 also moved out. For ease of description, operation of a single countertop extension will be described herein. However, it is to be understood that operation of each countertop extension is similar, with extensions from each respective side of countertop extension system 50.

To extend countertop surface 102, pull out assembly 40 is extended from the cabinet 110. When pull out assembly 40 reaches its furthest extended position, as in FIG. 2, extension support 410 may be pivoted about hinge 412, to an orthogonal position with respect to shelf 408. Thereafter, upper countertop extension 52 or lower countertop extension 54 can be pulled out of the countertop extension. Countertop extension 52, 54 is pulled to its maximum extent over extension support 410 and rests thereon. This configuration with upper countertop extension 52 or lower countertop extension 54 provides a stable and sturdy extension of countertop 102. Further, in this position as illustrated in FIG. 2, shelf 408 now enables further temporary storage space for the user of the convertible furniture unit 1.

In accordance with the aspects of the embodiment, pull out assembly 40 and upper countertop extension 52 or lower countertop extension 54 are illustrated with handles 409. Moreover, pull out assembly 40 and upper countertop extension 52 or lower countertop extension 54 may be provided with handles, knobs, finger grips, and any other configuration or structure now known or hereinafter developed, to facilitate and expedite movement of those elements. As embodied by the disclosure, latch assembly 700 (FIGS. 25-27) can be provided at edges of counter extension 52 and/or counter extension 54. Latch assembly 700 locks counter extension 52 and/or counter extension 54 at an optimal pulled out extension length. A latch assembly 700 can be a compliant mechanism provided on each side edge of counter extension 52 and/or counter extension 54. User can press both latch assemblies 700 inward at the same time to release counter extension 52 and/or counter extension 54 to either push counter extension 52 and/or counter extension 54 back into the countertop assembly 10 or to pull counter extension 52 and/or counter extension 54 all the way out for access.

FIGS. 3-7 illustrate convertible furniture unit 1 and components of convertible furniture unit 1 in the island configuration.

In the island position of convertible furniture unit 1, countertop assembly 10 is typically positioned above a supporting surface to match a standard counter height. A height of countertop assembly 10 is provided for a user's comfortable standing ergonomic position. In a non-limiting and illustrative height, countertop assembly 10 can be about 90 cms (about 36 inches) unit above the supporting surface.

In the island configuration of convertible furniture unit 1, female wing 20 and male wing 30 are in their storage or down position. Female wing 20 and male wing 30 support countertop assembly 10 as female wing 20 and male wing 30 are configured to be connected to countertop assembly 10. In one aspect of the embodiments, female wing 20 and male wing 30 are connected at hinges 202 to counter extension system 50 and by hinges 220, 320 of female wing 20 and male wing 30, respectively, to pivot plate 602 of countertop 110 as will be described hereinafter.

Figure 4:
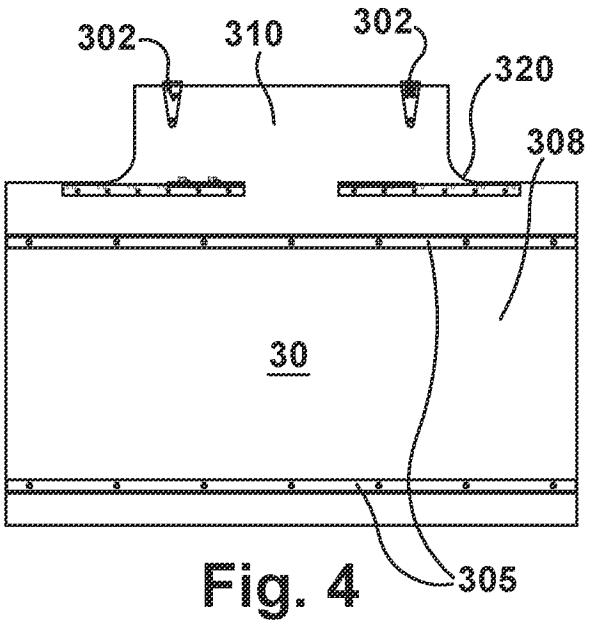
FIG. 4 is a schematic illustration of a male wing of a furniture unit that converts from a counter to a table in the table or desk position according to embodiments of the disclosure.

With reference to FIGS. 3 and 4, female wing 20 and male wing 30 are illustrated. FIG. 3 illustrates female wing 20. Female wing 20 includes a central cut out portion 201 and two tab portions 210. Tab portions 210 are at the left and right side of female wing 20, as illustrated in FIG. 3. Moreover, female wing 20 includes a plurality of hinges 202 which connect to counter extension system 50, as will be described hereinafter. Furthermore, female wing 20 includes hinges 220. In an aspect of the embodiments, hinges 220 connect to pivot plate 602 of cabinet top 110.

Figure 5:
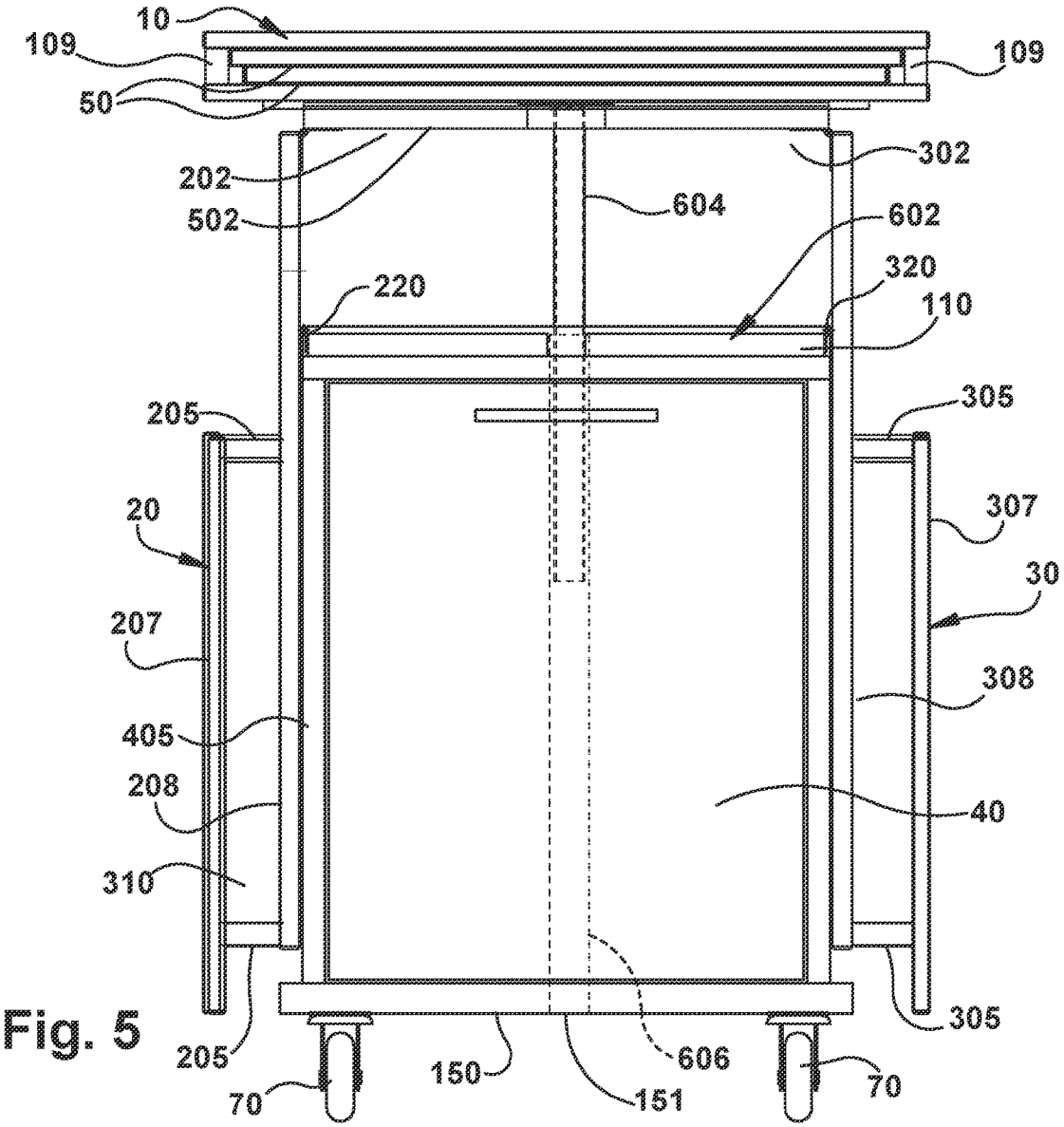
FIG. 5 is an end view as a partial sectional perspective view of a furniture unit that converts from a counter to a table in the island position according to embodiments of the disclosure.
Figure 11:
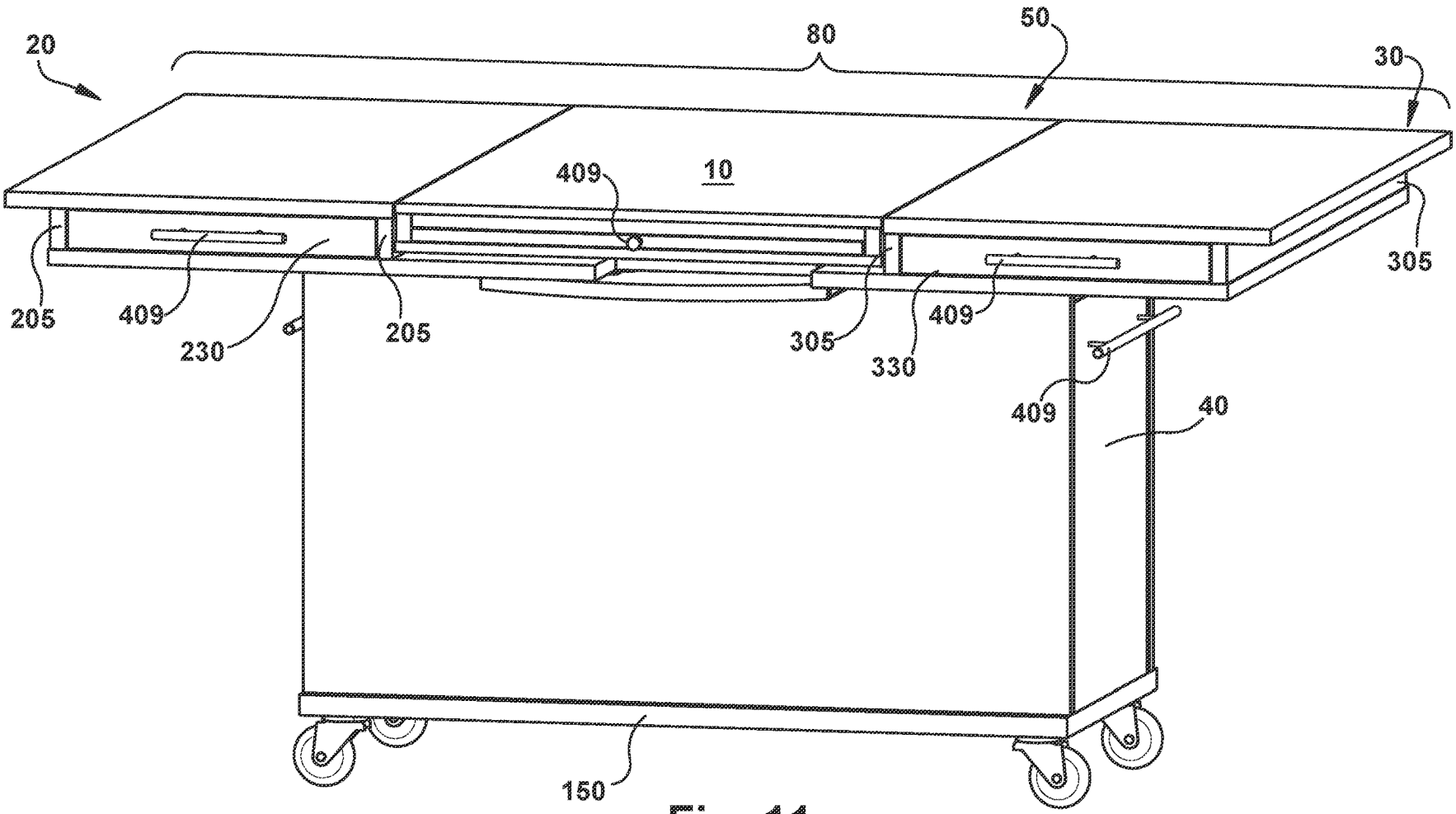
FIG. 11 illustrates a side perspective view of a furniture unit that converts from a counter to a table in the table or desk position according to embodiments of the disclosure.

Connection of hinges 202 and 220 to cabinet assembly 100 are configured to support countertop assembly 10, as in FIG. 5. Moreover, with reference to FIGS. 3 and 5, female wing 20 includes a female top panel 207, which faces outwardly in the storage position of convertible furniture unit 1. Top panel 207 of female wing 20 is vertically oriented in the table position, as shown in FIG. 11 and described hereinafter. Female wing 20 also includes a female bottom panel 208. Female wing 20 includes female spacers 205, which distance female top panel 207 from bottom panel 208. Accordingly, female wing 20 by virtue of female top panel 207, female bottom panel 208, and female spacers 205 presents a storage area for custom drawers 230 (FIGS. 1-3). In FIG. 11, which is a table configuration of convertible furniture unit 1, custom drawers 330 are positioned to be extended for easy access by a user of convertible furniture unit 1.

As embodied by the disclosure, drawers 330 may be configured large enough to span female wing 20 and male wing 30. Thus, drawer 330 is as long as female wing 20 and a male wing 30, so when drawer 330 is pulled from one side of female wing 20 or male wing 30, the opposite side of drawer 330 pulls inside and under the respective female wing 20 or male wing 30. Alternately, as embodied by the disclosure, drawer 330 may be provided as two distinct drawers, each extendable from each side of convertible furniture unit 1. Additionally, as embodied by the disclosure, drawers may be configured large enough to store serving trays, placements, or elongated items. Moreover, as embodied by the disclosure, drawers 330 are configured to be rigid and strong to hold serving platters, bowls and the like when convertible furniture unit 1 is in a table configuration.

FIG. 4 illustrates male wing 30. Male wing 30 includes a tab portion 310. Tab portion 310 is positioned at a central portion of male wing 30, as illustrated in FIG. 4. Moreover, male wing 30 includes a plurality of hinges 302 which connect to pivot assembly 60, as will be described hereinafter. Furthermore, male wing 30 includes hinges 330. In an aspect of the embodiments, hinges 330 connect to pivot plate 602 of cabinet top 110. Connection of hinges 302 and 330 to cabinet assembly 100 are configured to support countertop assembly 10, as in FIG. 5. Moreover, with reference to FIGS. 3 and 5, male wing 30 includes a male top panel 307, which faces outwardly in the storage position of convertible furniture unit 1. Top panel 307 of male wing 30 is vertically oriented in the table position, as shown in FIG. 11 and described hereinafter. Male wing 30 also includes a male bottom panel 308. Male wing 30 includes male spacers 305, which distance top panel 307 from bottom panel 308. Accordingly, male wing 30 by virtue of male top panel 307, male bottom panel 308, and male spacers 305 presents a storage area for custom drawers 330 (FIGS. 1-3). In FIG. 11, which is the table configuration of convertible furniture unit 1, custom drawers 230 and 330 extend for easy access by a user of convertible furniture unit 1.

Figure 6:
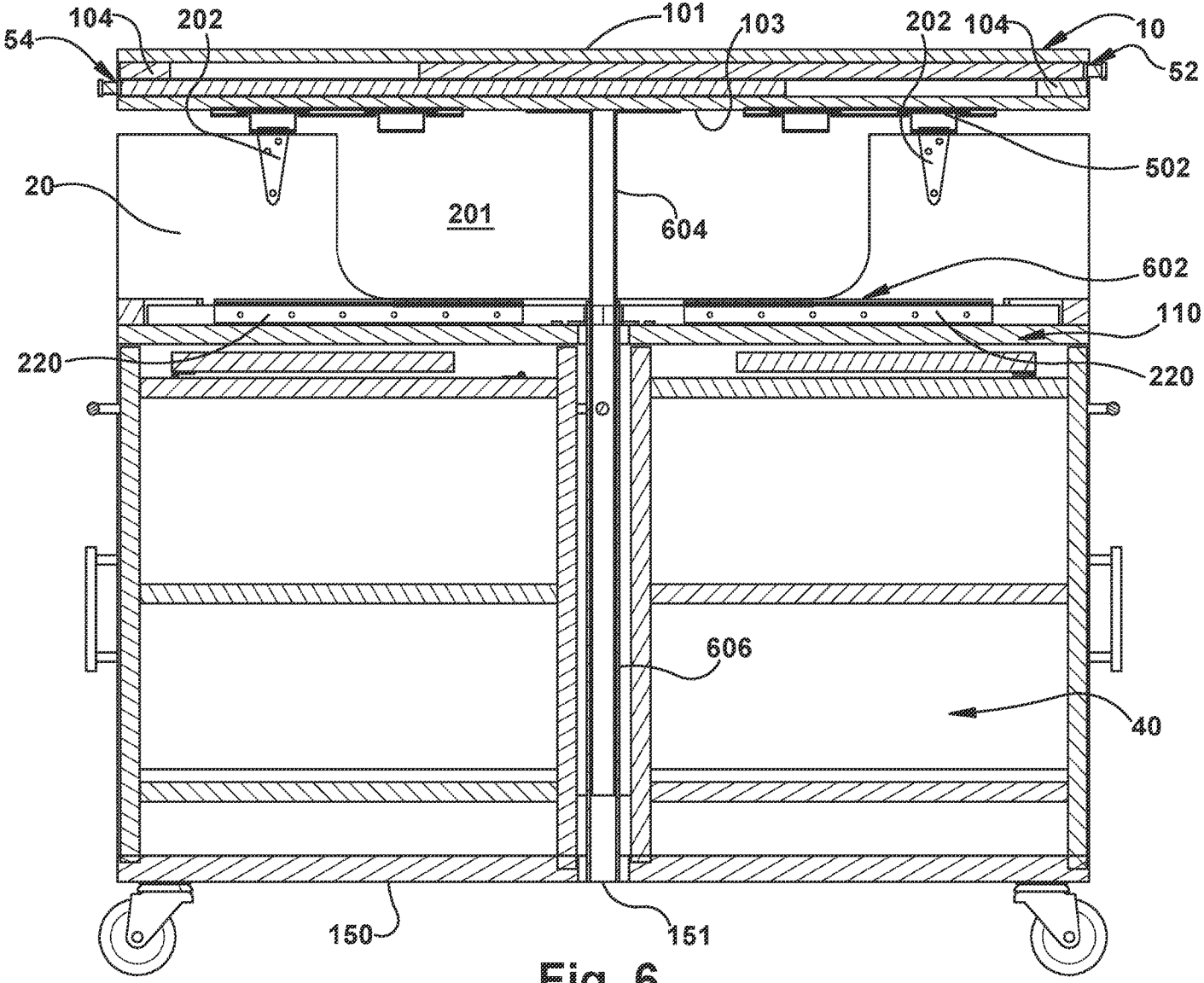
FIG. 6 is a side view as a partial sectional perspective view of a furniture unit that converts from a counter to a table in the island position according to embodiments of the disclosure.
Figure 7:
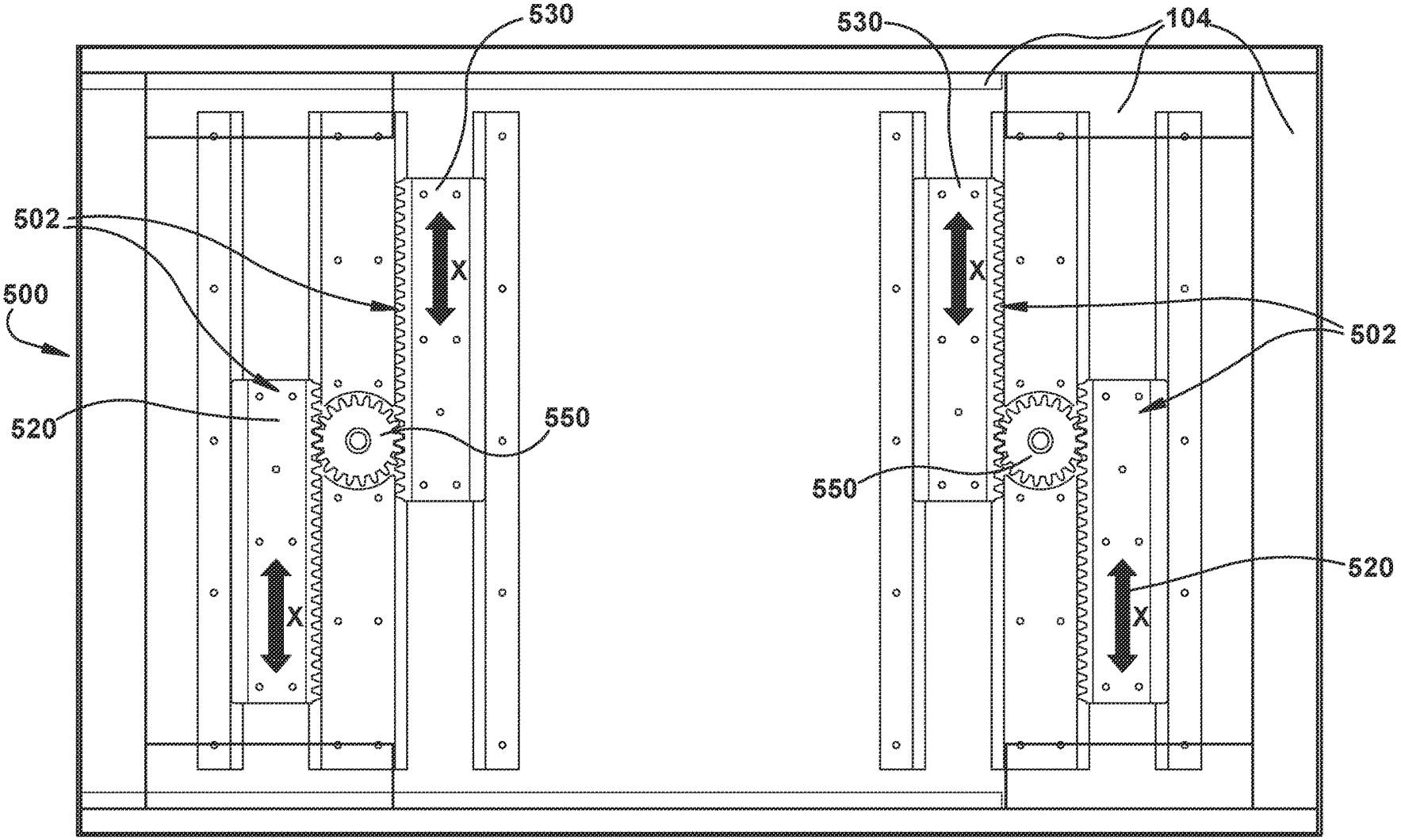
FIG. 7 is a top view as a partial sectional perspective view of a furniture unit that converts from a counter to a table in the island position according to embodiments of the disclosure.

FIGS. 5-7 illustrate partial sectional and three-dimensional aspects of the convertible furniture unit 1 in the island position. FIGS. 5 and 6 illustrate a bottom 150 of cabinet 110 of convertible furniture unit 1. Bottom of cabinet 110 includes a cut out 151. Cut out 151 supports a pivot tube 606. In this aspect of the embodiment, pivot assembly 60 includes a pivot rod 604 that is disposed in pivot tube 606. Pivot rod 604 is connected to countertop assembly 10 and is configured to enable rotation of countertop assembly 10. Rotation of countertop assembly 10 changes convertible furniture unit 1 from its island position as shown in FIGS. 1 and 2 to its table configuration in FIG. 11. The conversion from the island configuration to the table configuration will be described with respect to FIGS. 12-20.

Countertop assembly 10 includes upper countertop extension 52 and lower countertop extension 54. Upper countertop extension 52 and lower countertop extension 54 are disposed in countertop assembly 10. As embodied by the disclosure, upper countertop extension 52 and lower countertop extension 54 are positioned between upper countertop 101 which includes countertop surface 102, and lower countertop assembly surface 103. Countertop spacers 104 provide a space between upper countertop 101 and lower countertop 103. Accordingly, as embodied by the disclosure, this configuration allows upper countertop extension 52 and lower countertop extension 54 to be slidably retained in countertop assembly 10. Thus, as needed to convert the island position into the extended island position, from FIG. 1 to FIG. 2, convertible furniture unit 1 and countertop assembly 10 are configured to enable a user to extend one or both of upper countertop extension 52 and lower countertop extension 54 by pulling on handle 409.

FIG. 6 is a side sectional perspective of convertible furniture unit 1. FIG. 6 is shown with male wing 30 removed from the figure for ease of illustration and to facilitate understanding. FIG. 6 illustrates female wing 30 at the far side of convertible furniture unit 1. Cutout 201 of female wing 20 (see FIGS. 1, 2, and 6) is configured to enable users of convertible furniture unit 1 to access and temporarily store items on cabinet top 602 of cabinet 110 underneath countertop assembly 10. Given the positioning of cutout 201 and the overall height of convertible furniture unit 1 items stored on cabinet top 602 enables a user to have ready access thereto.

Moreover, as seen in FIG. 6, hinges 302 are attached to wing extension system 500 at slider assembly with a rack and pinion gear system 502. As embodied by the disclosure, FIG. 7 illustrates a partial schematic illustration at a top sectional perspective where female wing 20 and male wing 30 are not illustrated. Further, FIG. 7 presents a transparent perspective of countertop assembly 10. Accordingly, counter extension system 50 with sliders with a rack and pinion gear system 502 is visible in FIG. 7.

Sliders with a rack and pinion gear system 502 include geared racks 520 for female wing 20 and a geared rack 530 for the male wing 30. Hinges 202 of the female wing 20 and hinges 302 of the male wing 30 are configured to be attached to the respective geared racks 520 and 530. A gear and pinion 550 is disposed between geared rack 520 for female wing 20 and geared rack 530 for male wing 30. Accordingly, movement of one of female wing 20 and male wing 30 will cause movement of the respective geared rack 520 or 530. Pinion 550 is configured for being rotated as gear rack 520 or geared rack 530 laterally moves, and thus the other of gear rack 520 or geared rack 530 laterally moves, as indicated by arrows X in FIGS. 7 and 14.

Accordingly, a user of convertible furniture unit 1 may raise one or the other of female wing 30 or male wing 30 and cause pivoting and rising motion of the other of female wing 30 or male wing 30. As respective female wing 30 or male wing 30 pivots on hinges 230 or 330. Also, as female wing 20 and male wing 30 are connected to cabinet top 110 by hinges 210 and 310, raising one or the other of female wing 30 or male wing 30 will also cause the other of female wing 30 or male wing 30 to pivot and rise, as described hereinafter. As embodied by the disclosure, other mechanisms for raising female wing 20 and male wing 30 are also envisioned in convertible furniture unit 1. For example, and in no manner intended to limit the embodiments in any way, pulleys, belts, motors, pneumatics, levers, and the like may be employed raising female wing 20 and male wing 30.

Figure 8:
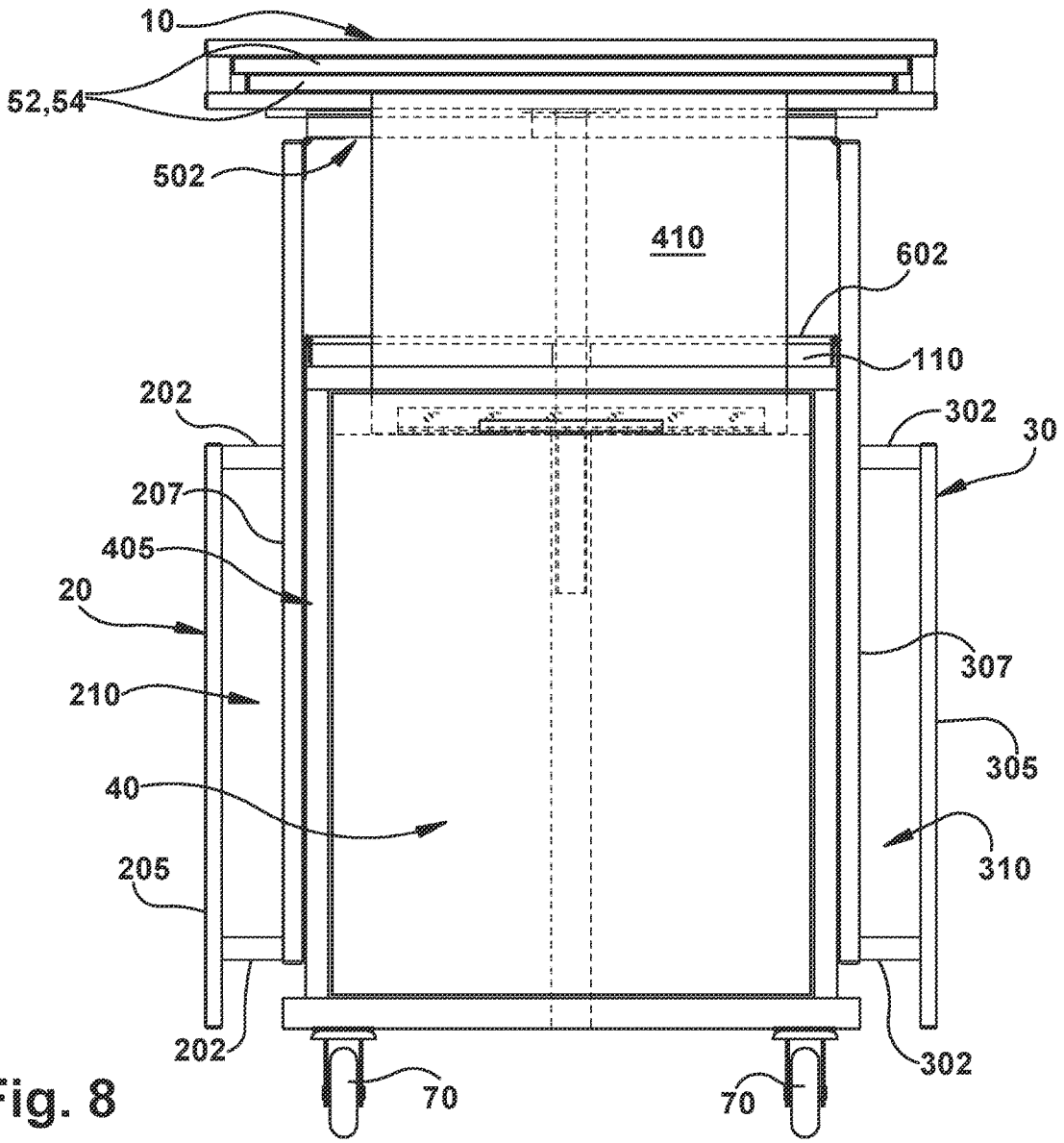
FIG. 8 is an end view as a partial sectional perspective view of a furniture unit that converts from a counter to a table in the extended island position according to embodiments of the disclosure.
Figure 9:
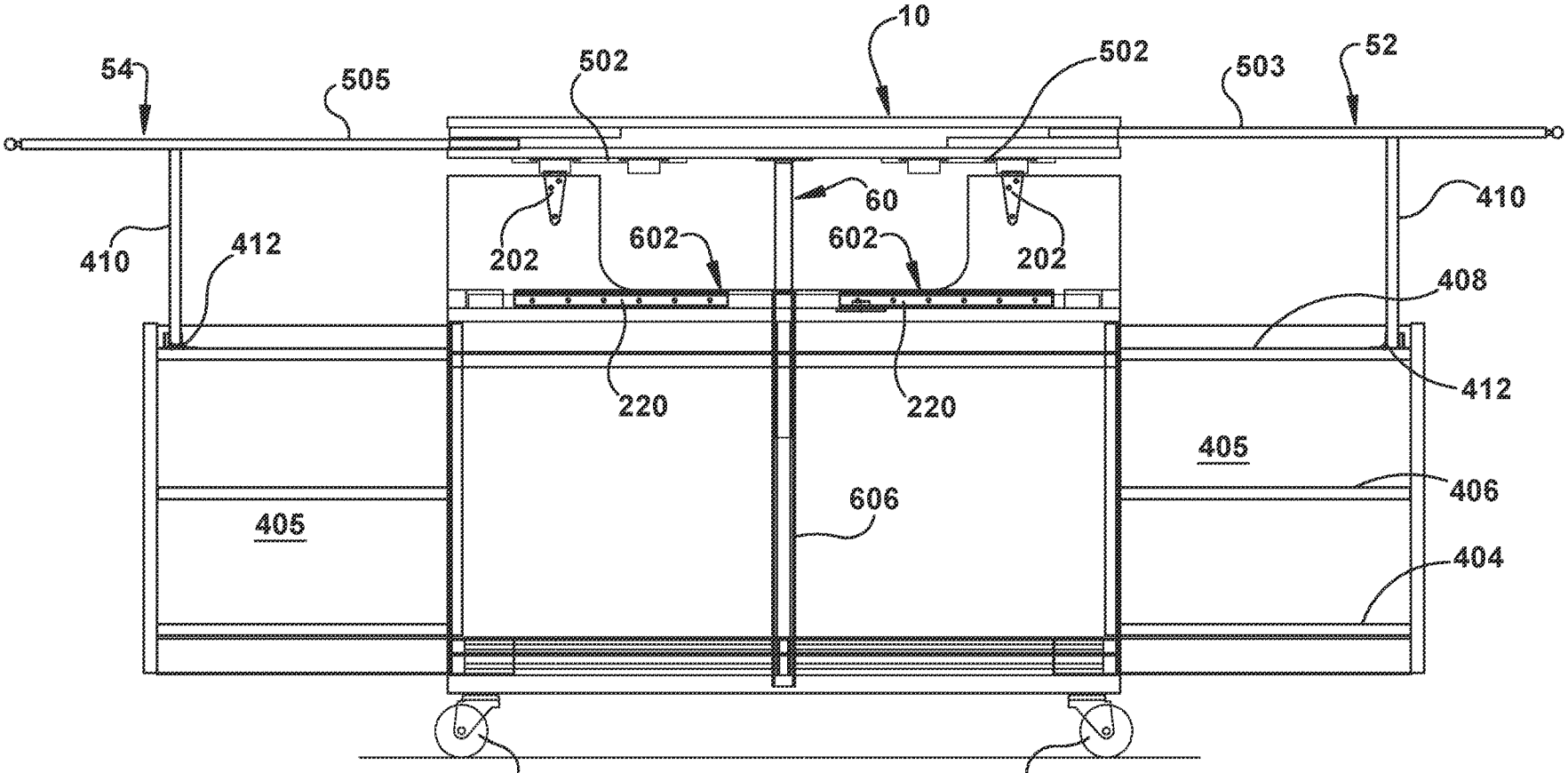
FIG. 9 is a side view as a partial sectional perspective view of a furniture unit that converts from a counter to a table in the extended island position according to embodiments of the disclosure.
Figure 10:
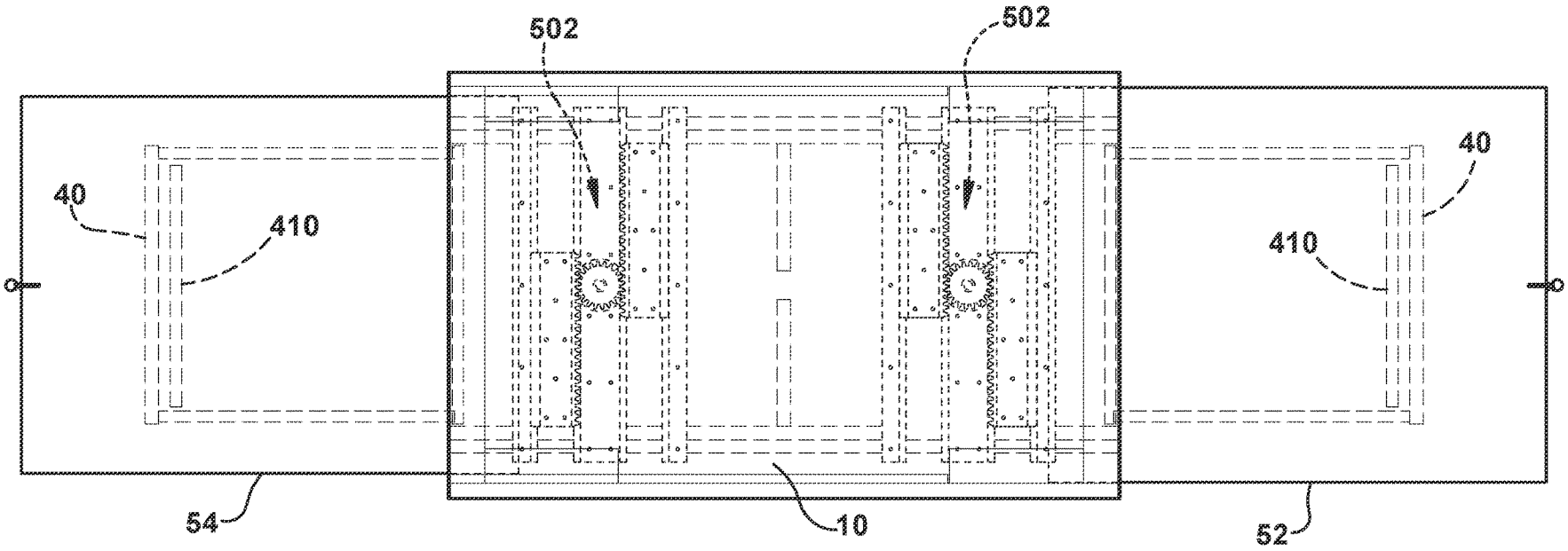
FIG. 10 is a top view as a partial sectional perspective view of a furniture unit that converts from a counter to a table in the extended island position according to embodiments of the disclosure.

The convertible furniture unit 1 will now be described in terms of FIGS. 8-10 in the extended island position of convertible furniture unit 1. The extended island position is shown schematically in FIG. 2. The length of the island and island working counter space in convertible furniture unit 1 can be extended by moving pull outs 40 and then pulling out one or both of upper counter extension 52 and lower counter extension 54 from countertop extension system 50.

In their stored position, upper countertop extension 52 and lower countertop extension 54 overlap. Here, the term "overlap" means that one countertop extension is higher than the other countertop extension, when upper countertop extension 52 and lower countertop extension 54 are stored within the countertop assembly 10. Spacers 104 spacers are provided to maintain a distance between upper countertop 101 and lower countertop 103. This distance enables storage of the upper countertop extension 52 and the lower countertop extension 54 in countertop assembly 10. Given the stored arrangement configuration of upper countertop extension 52 and lower countertop extension 54 in countertop assembly 10, an aspect of the embodiments may provide lower countertop extension 54 being configured narrower in thickness than upper countertop extension 52.

The countertop assembly 10 is supported on and by female wing 30 or male wing 30 respectively via the hinges 230 and 330 and 302 and 302. This support configuration is illustrated FIGS. 5, 6, 8, and 9.

FIG. 11 illustrates the convertible furniture unit 1 in a dining table position. Described hereinafter, the convertible furniture unit 1 is configured to convert to a dining table configuration by transitioning from a counter configuration (FIG. 1) to a table configuration (FIG. 11). In the table configuration (FIG. 11), countertop 10 and countertop surface 102 of convertible furniture unit 1 may be at a lower vertical height then when convertible furniture unit 1 is in its counter configuration. Thus, seating around convertible furniture unit 1 in its table configuration is comfortable and suitable for dining.

Figure 12:
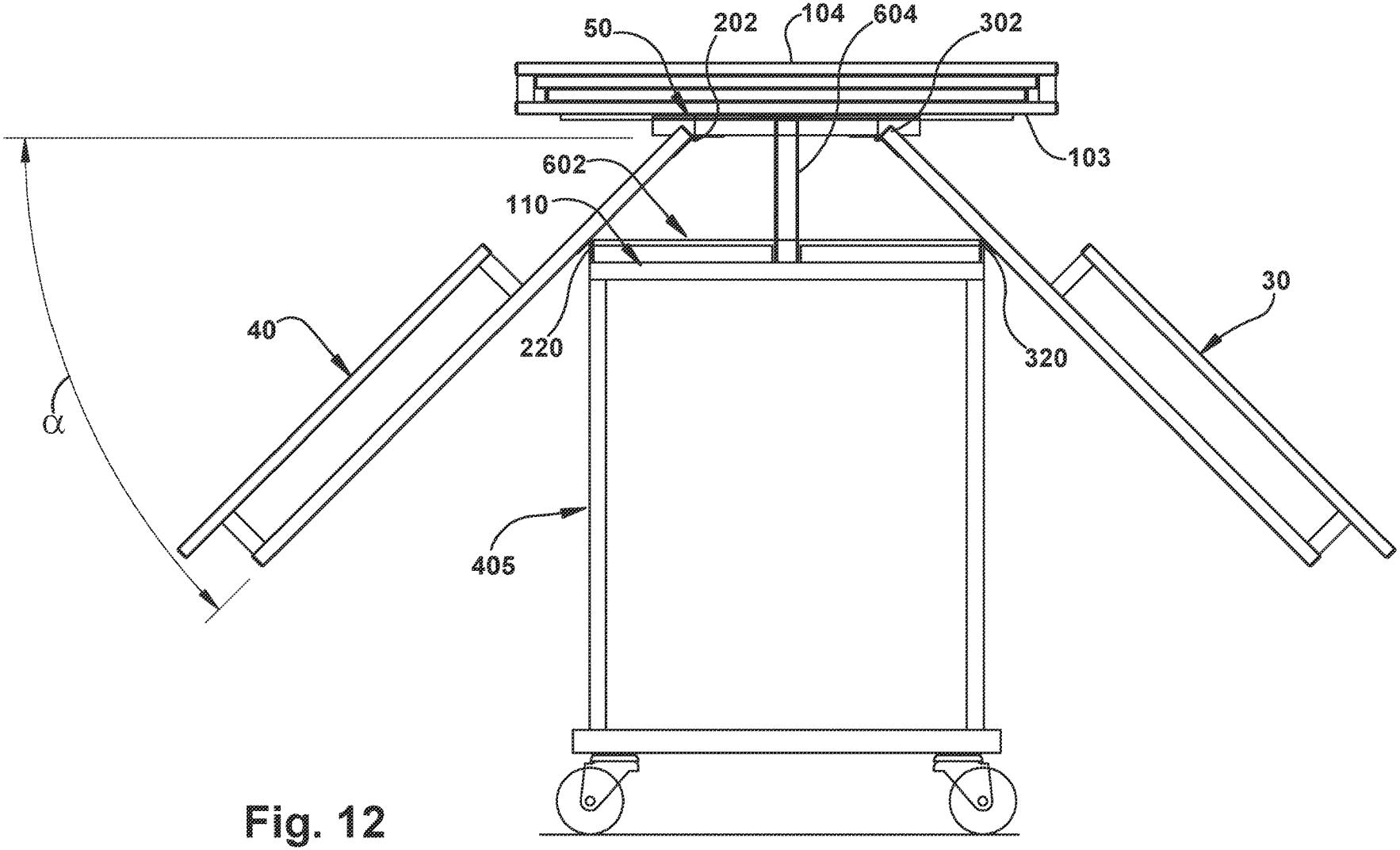
FIG. 12 is an end view as a partial sectional perspective view of a furniture unit that converts from a counter to a table in the table or desk transitioning from the island position to the table position according to embodiments of the disclosure.
Figure 13:
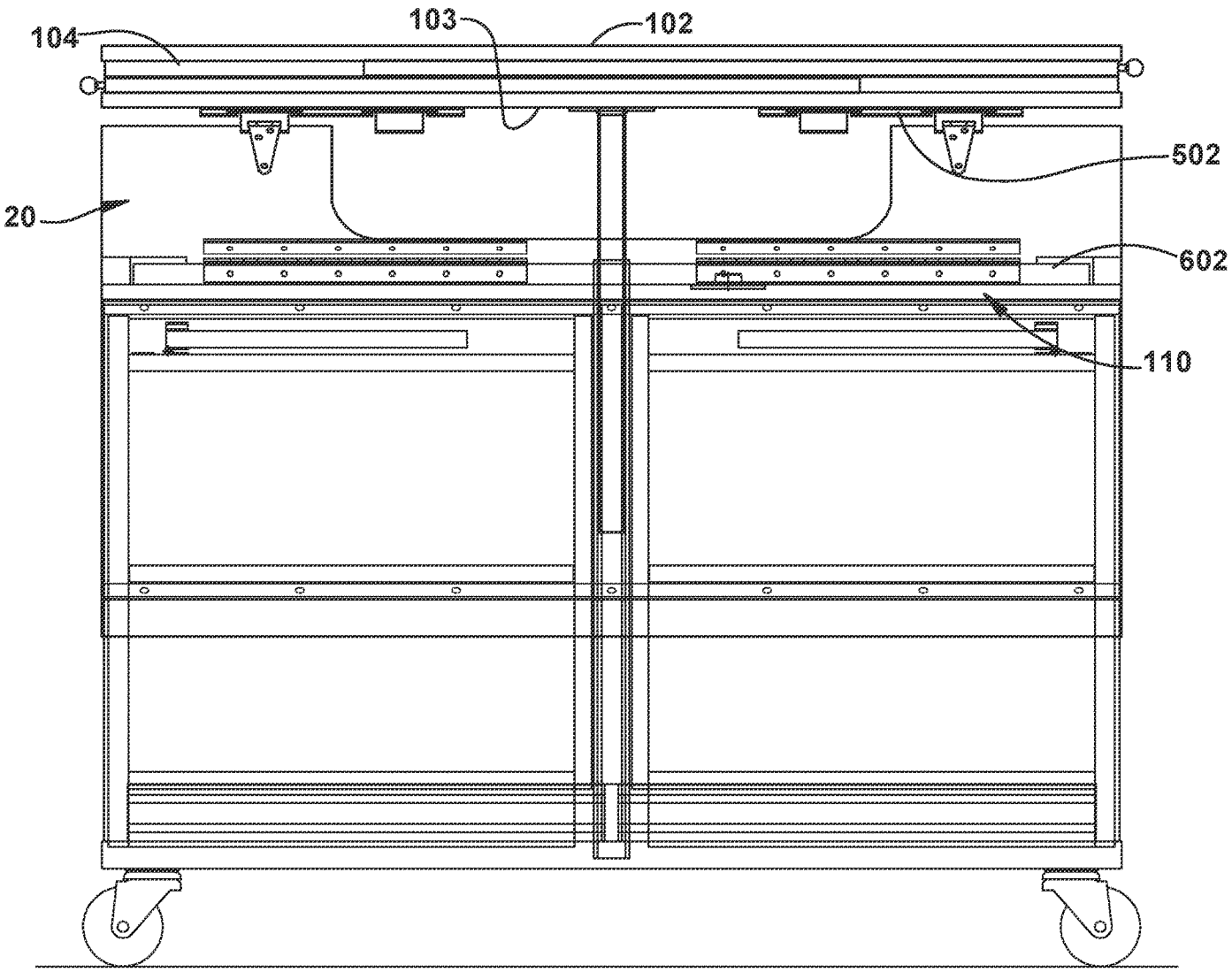
FIG. 13 is a side view as a partial sectional perspective view of a furniture unit that converts from a counter to a table in the table or desk transitioning from the island position to the table position according to embodiments of the disclosure.
Figure 14:
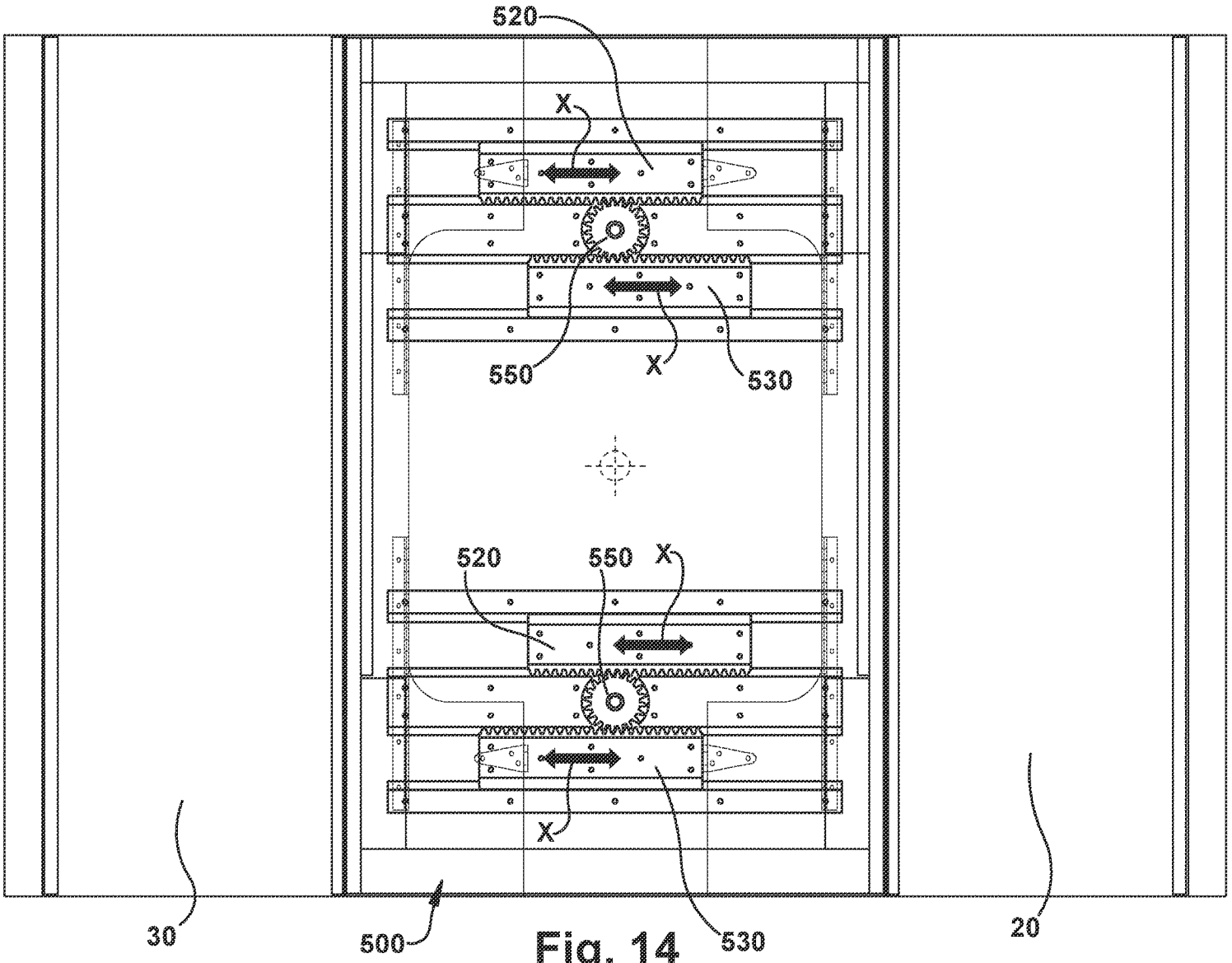
FIG. 14 is a top view as a partial sectional perspective view of a furniture unit that converts from a counter to a table transitioning from the island position to the table position according to embodiments of the disclosure.

With respect to FIGS. 11-13, transitioning the convertible furniture unit 1 from the island configuration to a table configuration includes pivoting female wing 20 and male wing 30 to their respective horizontal positions. Thereafter, rotating the countertop assembly, inclusive of the female wing and male wing ninety degrees)(90° to the longitudinal table position, as shown in FIG. 11.

In FIG. 12, each of the female wing 20 and the male wing 30 pivot or hinge at hinge 220. The pivot is at one edge of the pivot table pivot plate 602. The top edge of each wing is hinged at hinge 202 to a slider 520. Linear gear 521 is attached to the wing extension system 500 with a rack and pinion gear system 502. Pinions 550 are attached to a bottom surface 103 of countertop assembly 10. Pinions 550 are configured to rotate when linear gear 521, which is attached to slider 520, is translated and moved by pivoting of either female wearing 20 or male wing 30. Female wing 20 is pivotally connected to outermost linear gears 520 while male wing is pivotally connected to innermost linear gears.

To initiate the transition from the island position in FIG. 1 to the table position in FIG. 11, a user of the convertible furniture unit 1 lifts one of the wings, either female wing 20 or male wing 30. As the respective wing, either female wing 20 or male wing 30, is lifted it is in a hinged relation to the pivot plate 602 at top edge where hinges 202 or 302, respectively, are provided. Whereas the top edge of either female wing 20 or male wing 30 is connected to slider 520, slider 520 moves inward towards pivot tube 604 at the center of countertop assembly 10 bottom surface.

Inward motion of either female wing 20 or male wing 30 translates to the respective slider 522 to which it is hinged. Sliders 552 are mounted to gear racks of linear gear 521 of the rack and pinion gear system 502. Lateral movement of sliders 552, as shown by arrow X in FIGS. 7 and 14, transfer to and cause sliders 552 to turn the pinion 550 gear which causes sliders 552 attached to an opposite wing, either female wing 20 or male wing 30, to move in an opposite direction.

As seen in FIG. 12, wings, either female wing 20 or male wing 30, are moved in a pivot arc alpha a. As wings, female wing 20 and male wing 30, are rotated, female wing 20 and male wing 30 are configured to pivot up as pivot rod 604 slides down into pivot tube 606. The moving down of pivot rod in pivot tube 606 caused by pivoting of female wing 20 and male wing 30 lowers countertop assembly 10. For instance, and in a non-limiting description, countertop assembly 10 can be lowered from a height of about 0.9 meter (about 36 inches) for a counter height to a table height of about 0.75 meter (about 29 to 30 inches) from a supporting surface, such as a floor.

Pivot rod 604 in outer tube 606 centers and holds countertop assembly 10 centered in relation to cabinet assembly 100 and pivot plate 602. Pivot rod 604 and pivot tube 606 enable vertical movement only to permit sliders 520 of rack and pinion gear system 502, which are mounted underneath countertop assembly 10, to smoothly move causing movement. Such movement can raise and lower and lowering of countertop assembly 10 in conjunction with raising and lowering of one wing, either female wing 30 or male wing 30, and pivoting of opposite wing which is not being lifted by user, either female wing 30 or male wing 30. Thus, as embodied by the disclosure, shifting of the countertop assembly 10 towards one side or another as a wing, either female wing 30 or male wing 30, is lifted, is avoided.

Figure 15:
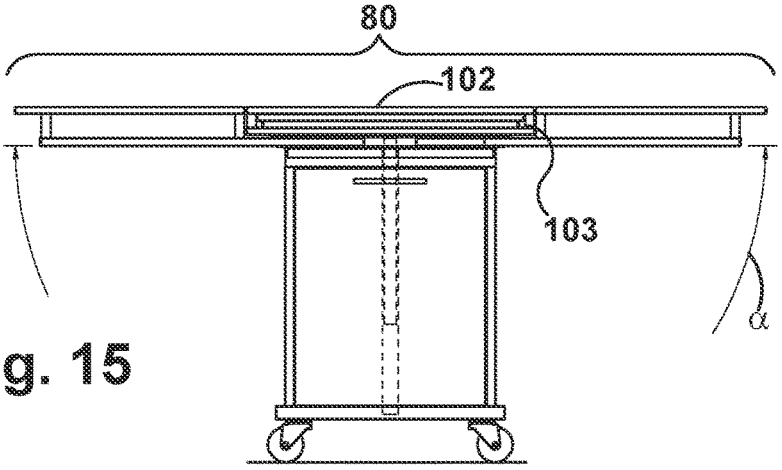
FIG. 15 is a further end view as a partial sectional perspective view of a furniture unit that converts from a counter to a table transitioning from the island position to the table position according to embodiments of the disclosure.
Figure 16:
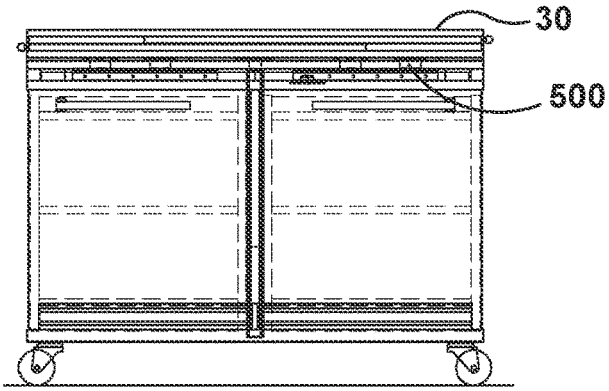
FIG. 16 is further a side view as a partial sectional perspective view of a furniture unit that converts from a counter to a table transitioning from the island position to the table position according to embodiments of the disclosure.
Figure 17:
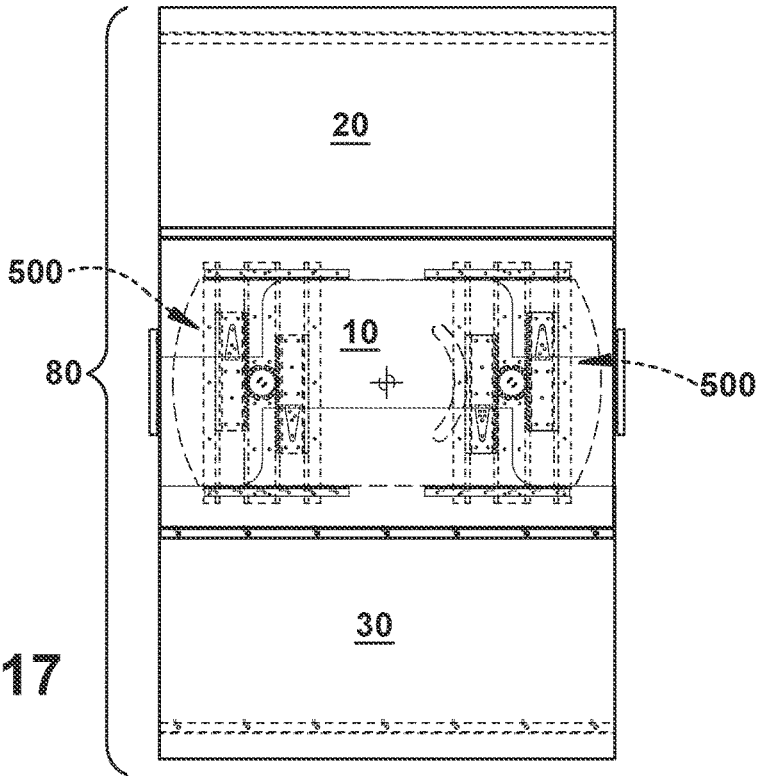
FIG. 17 is a further top view as a partial sectional perspective view of a furniture unit that converts from a counter to a table transitioning from the island position to the table position according to embodiments of the disclosure.

FIG. 15 illustrates female wing 20 and male wing 30 in their final pivoted position raised to the level of countertop assembly 10. FIG. 15 shows female wing 20 and a male wing 30 in their upright position. Each of female wing 20 and male wing 30 are hinged to pivot plate 602.

Figure 21:
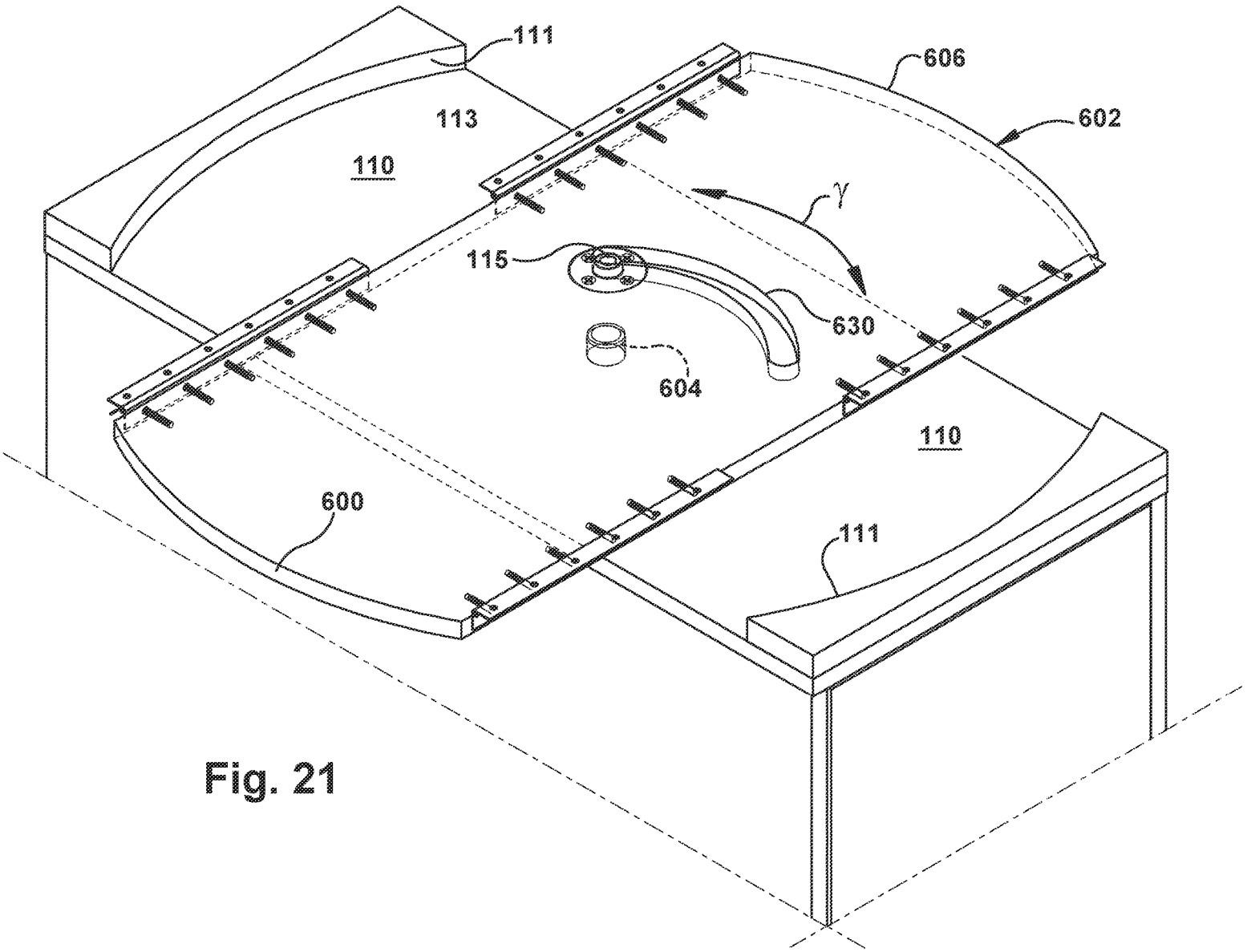
FIG. 21 is a schematic perspective illustration of a limiter configuration of a furniture unit that converts from a counter to a table according to embodiments of the disclosure.
Figure 22:
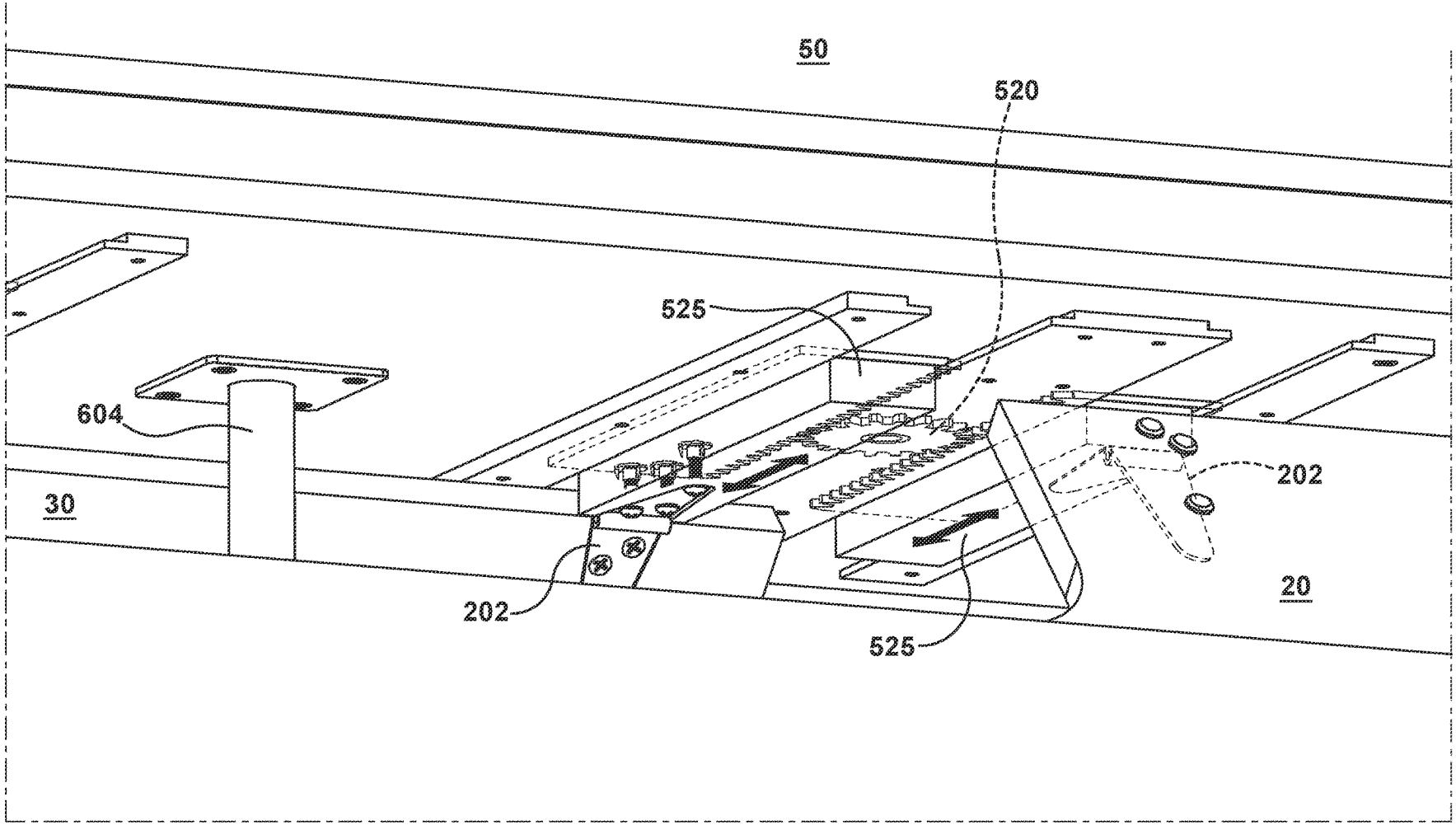
FIG. 22 is a schematic illustration of a counter extension configuration including sliders with rack and pinion gear system of a furniture unit that converts from a counter to a table according to embodiments of the disclosure.
Figure 23:
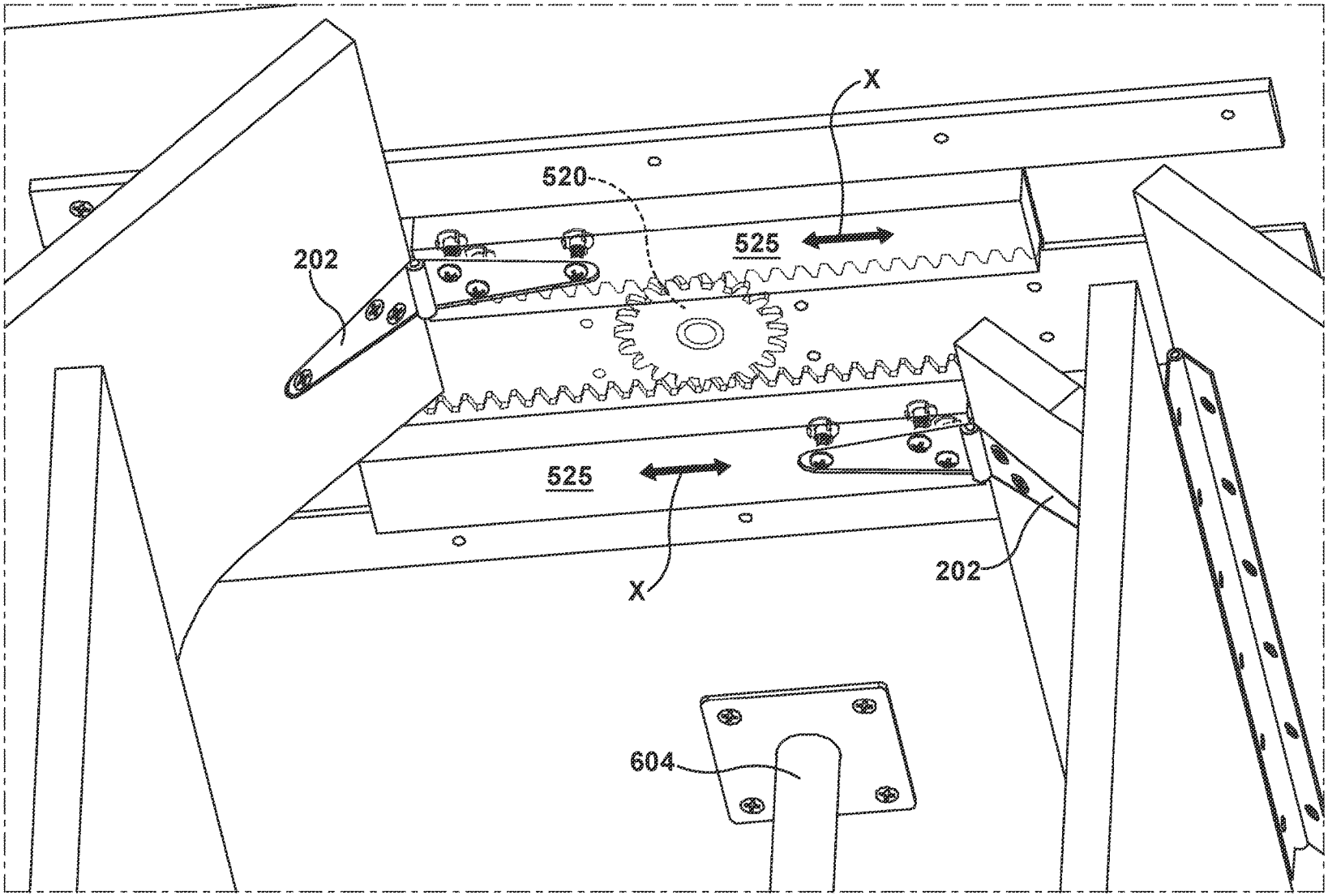
FIGS. 23 and 24 are a further schematic illustrations of main countertop assembly configurations including sliders with rack and pinion gear system of a furniture unit that converts from a counter to a table according to embodiments of the disclosure.
Figure 24:
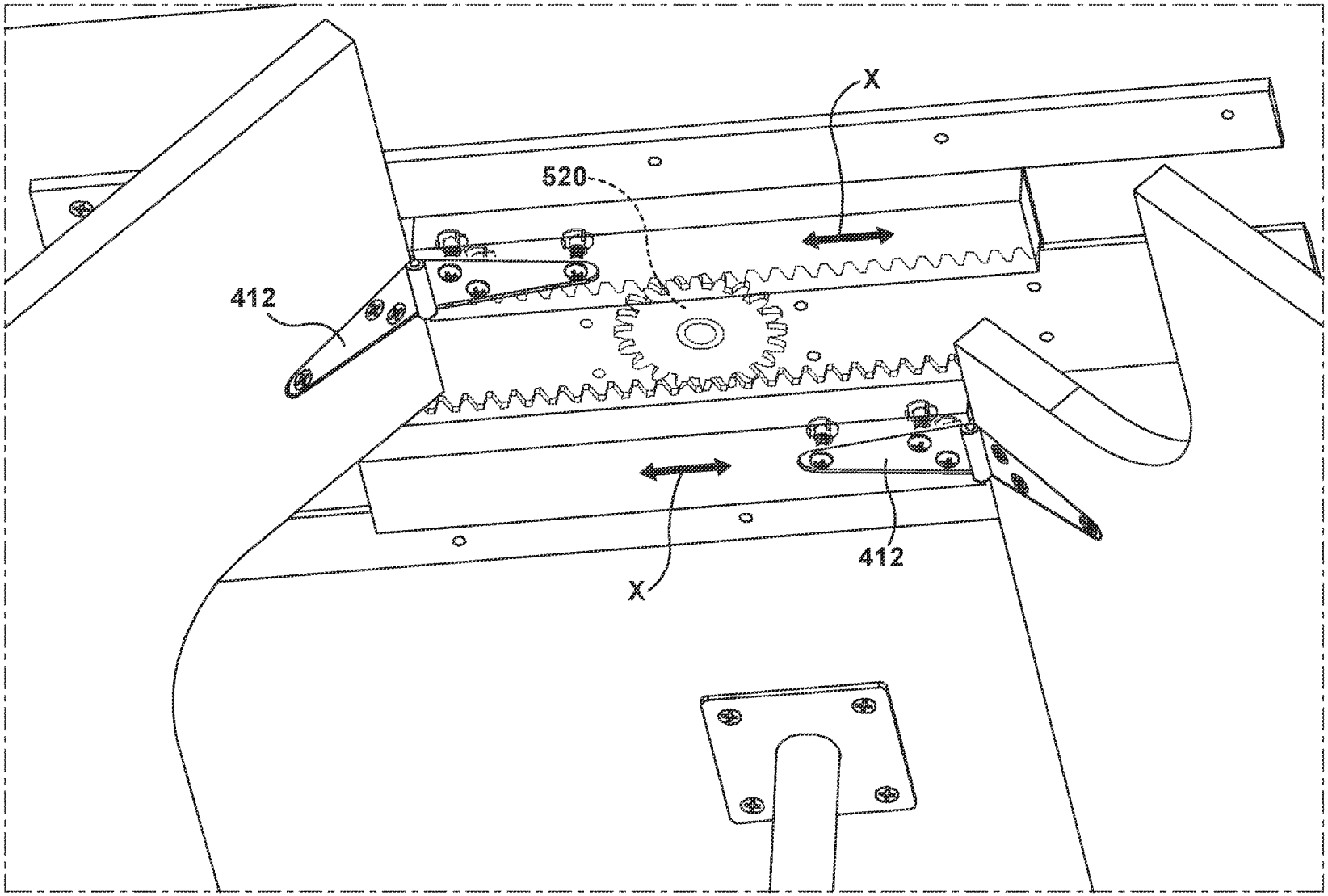

Pivot plate 602 is illustrated in FIG. 21. Pivot plate 602 includes a panel with arced sections 606 at each end. Pivot plate 602 rests on cabinet top 110 in grooved depression 113. Groove depression 113 extends an approximate equivalent length of pivot plate 602. Pivot plate 602 is configured to rotate around pivot rod 604 disposed in pivot tube 606 in rotational movement only. In the configuration illustrated in FIG. 21, pivot plate 602 lies orthogonally with respect to countertop 110.

Pivot plate 602 is configured to rotate in a limited arc. Limited arc is defined by a curve flat portion 630 in pivot plate 606. Stopper 115 can optionally be provided on cabinet top 110. Slot 630 and stopper 115 are configured to limit rotation of the tabletop 80 so that pivot plate 602 constrains rotational movement to 90° when tabletop 80 is rotated through arc gamma y.

Figure 18:
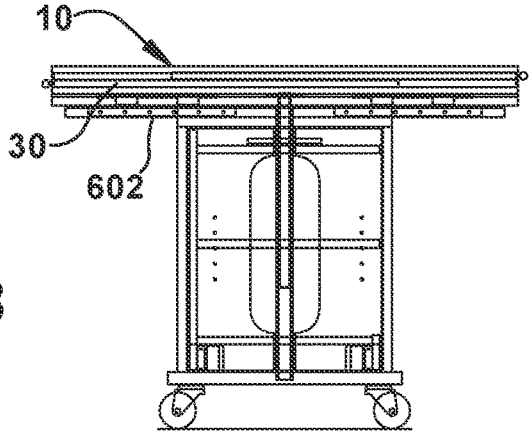
FIG. 18 is an end view as a partial sectional perspective view of a furniture unit that converts from a counter to a table in the table or desk in the table position according to embodiments of the disclosure.
Figure 19:
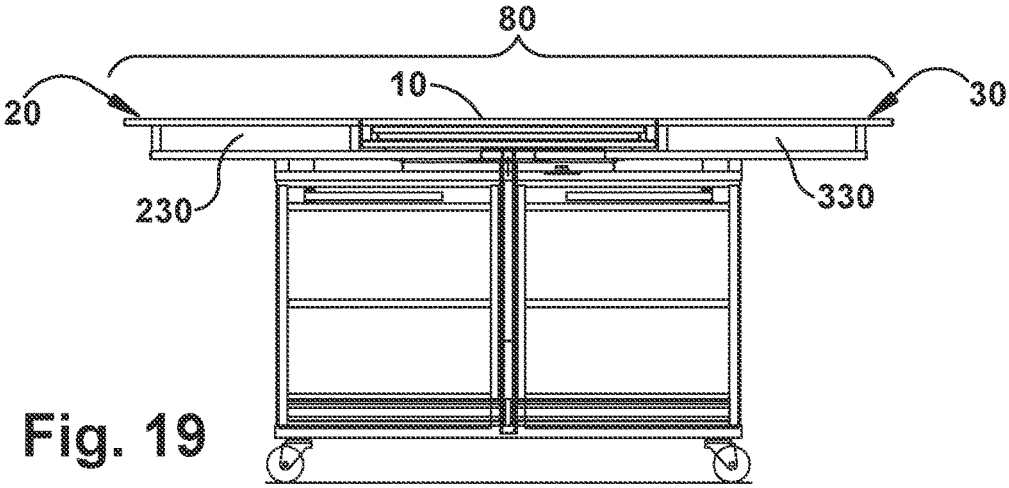
FIG. 19 is further a side view as a partial sectional perspective view of a furniture unit that converts from a counter to a table in the table or desk in the table position according to embodiments of the disclosure.
Figure 20:
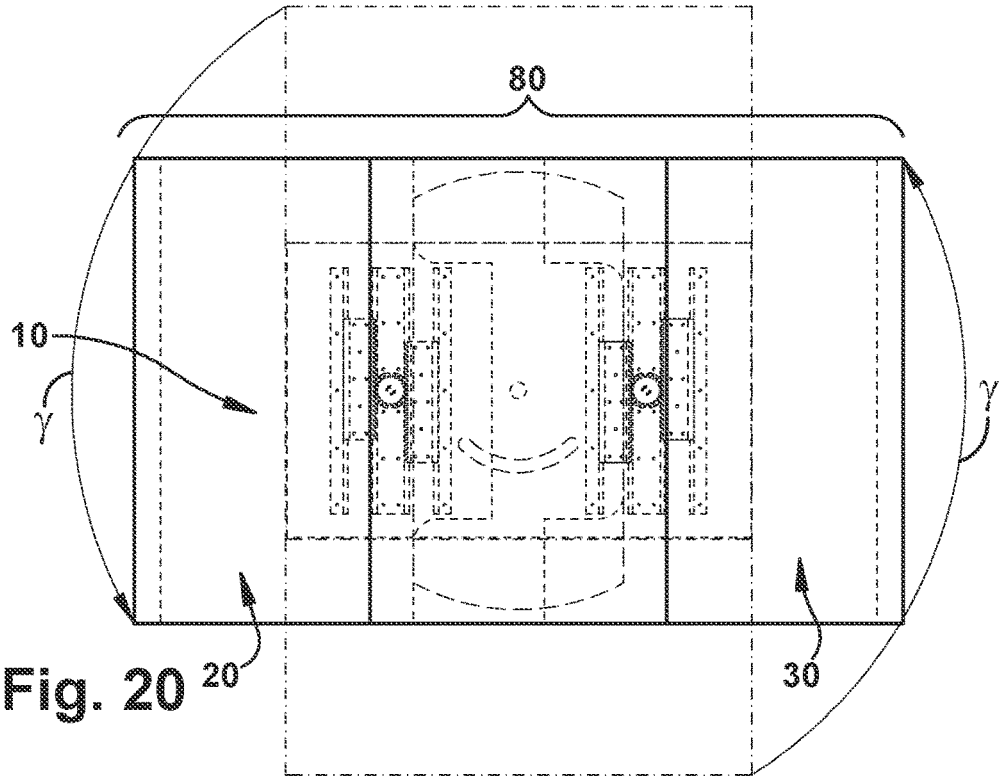
FIG. 20 is a further top view as a partial sectional perspective view of a furniture unit that converts from a counter to a table in the table position in the island position according to embodiments of the disclosure.

FIGS. 18-20 illustrate convertible furniture unit 1 with tabletop 80 rotated 90°. The 90° rotation of tabletop 80 includes female wing 20 and male wing 30 supported by ends of the cabinet top 110. This configuration is illustrated in FIGS. 19 and 20. In this rotated position, female wing 20 and male wing 30 cannot be rotated oppositely or hinged down into their storage position until tabletop 80 is rotated again or re-rotated to the counterclockwise direction to enable female wing 20 and male wing 30 to be retracted and pivoted down.

Rotating tabletop 80 in its extended or elongated position is configured to allow for space between and edge of tabletop 80 and cabinet 100. Thus, this space is configured to enable individuals to sit with knee space under tabletop 80.

Mechanics of tabletop 80 rotation include movement by pulling on one edge of one of the female wing 20 or the male wing 30 around pivot arc gamma y. This movement will rotate the entire pivot plate 602 surface to surface on the cabinet top 110. Pivot tube 602 and pivot rod 604 act as an axle or center axis for this rotation.

Technical advantages as embodied by the disclosure include enhanced and increased available space where convertible furniture unit 1 employed. Convertible furniture unit 1, as embodied by the disclosure, will help utilize space in a living area more efficiently, making the space feel homey and spacious at the same time. Also, convertible furniture unit 1 can reduce clutter, especially in limited living areas. Convertible furniture unit 1, as embodied by the disclosure, provides storage space, that allows you to keep clutter reduced and can keep living areas tidy, which in turn makes the living area feel inviting.

Additionally, convertible furniture unit 1, as embodied by the disclosure, can lower cost of living. Multi-functional furniture, such as convertible furniture unit 1, as embodied by the disclosure, negates multiple furniture pieces as one can have one item that can do multiple functions. This multi-functional aspect not only saves space but money as well. Convertible furniture unit 1 can be more economical than choosing individual furniture. Convertible furniture unit 1 may cut down the time, efforts and price spent on finding individual pieces of furniture and deliver benefits of one unit providing multiple uses.

Convertible furniture unit 1, as embodied by the disclosure, takes up little floor space. This reduced pace usage allows focus on accessorizing the living space in a variety of ways. For example saving space that a large table takes up in a living area by use of convertible furniture unit 1, as embodied by the disclosure, may add more "life" to a living area. Also, convertible furniture unit 1, as embodied by the disclosure, enables fewer items in a living space. Benefits of ewer items can make redecorating and moving easier.

Another aspect of convertible furniture unit 1, as embodied by the disclosure, includes optional latching configurations for movable features. While latching configurations for the movable features will be described with respect to the countertop assembly 10 and the slidable extensions 52, 54, aspects of the embodiment include incorporation of latching configurations at any of the sliding and moving elements of the convertible furniture unit 1. These locations include, but are not limited to, drawers, sliders, extensions, and other such movable elements. With respect to FIGS. 25-27, latch configuration includes latch assembly 700. Latch assembly 700 is disposed in a recess 710 on the slidable element, here upper or lower countertop extension 52, 54 (for ease of description, the latching configuration, as embodied by the disclosure will be referred with "countertop extension 52, 54." Latch assembly 700 includes a self-biased latch 702. Self biased latch 702 includes a pivot 704.

Self-biased latch 702 also includes a fixed arm 706 and a movable arm 708. Movable arm 708 includes a latching detent 711, detent slider portion 712, and a tab 714. Tab 714, as described herein, enables releasing of self-biased latch 702 when self-biased latch 702 is in the latched configuration, to be described hereinafter.

Figure 25:
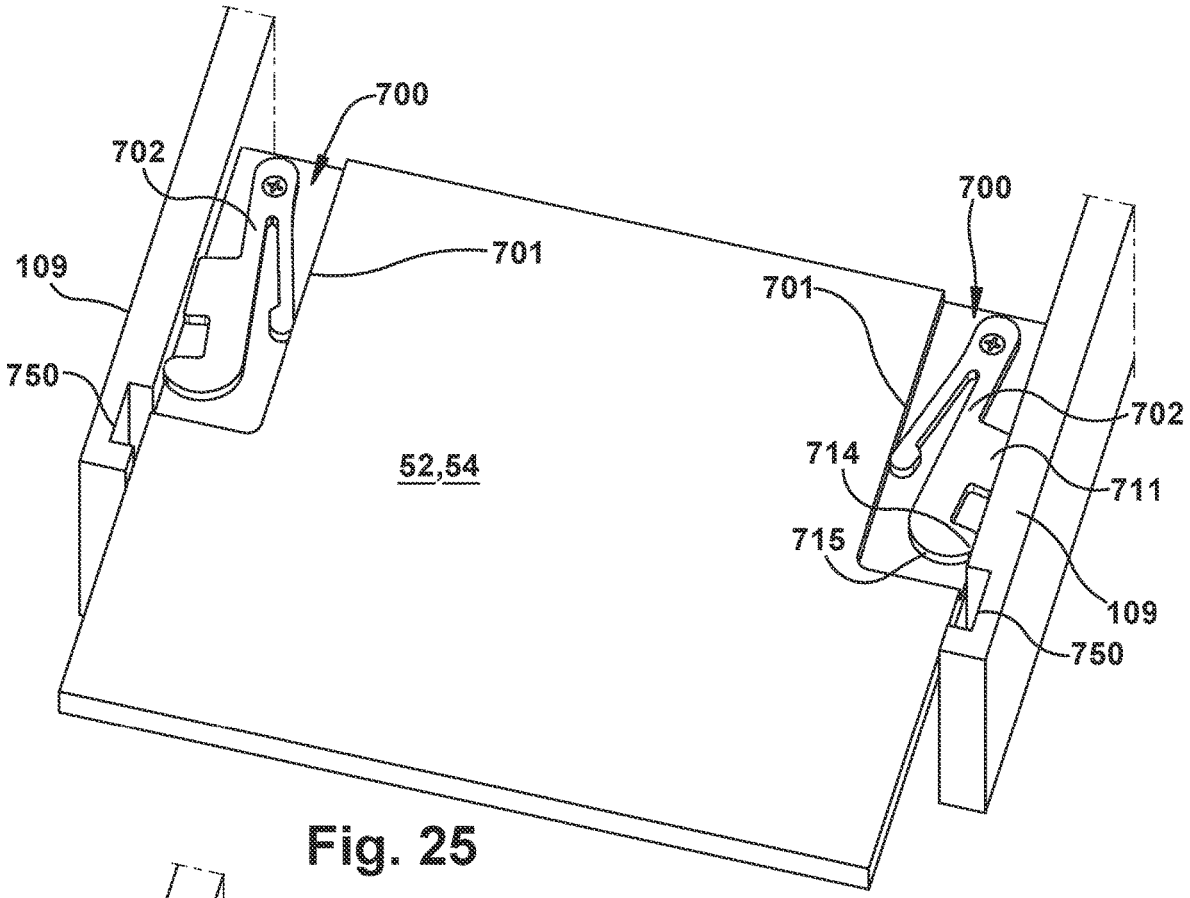
FIG. 25 is a schematic illustration of a latch configuration on the counter extension according to embodiments of the disclosure.
Figure 26:
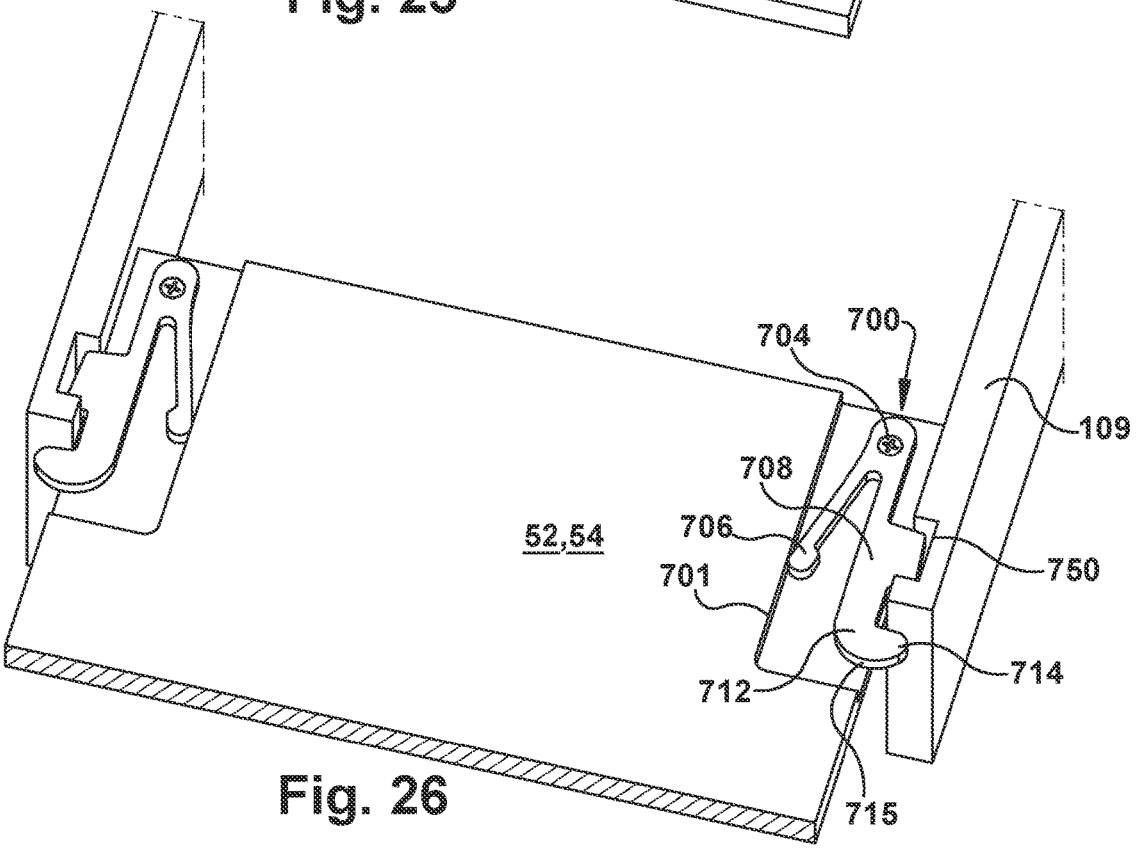
FIG. 26 is a schematic illustration of a latch configuration on the counter extension in the latched position according to embodiments of the disclosure.

FIG. 25 illustrates self-biased latch 702 in the unlatched position when countertop extension 52, 54 is in the retracted position under counter assembly 10. FIG. 26 illustrates self-biased latch 702 in the latched configuration when the countertop extension 52, 54 is in its extended position. Further, FIG. 27 is a close-up view of the self-biased latch 702.

Figure 27:
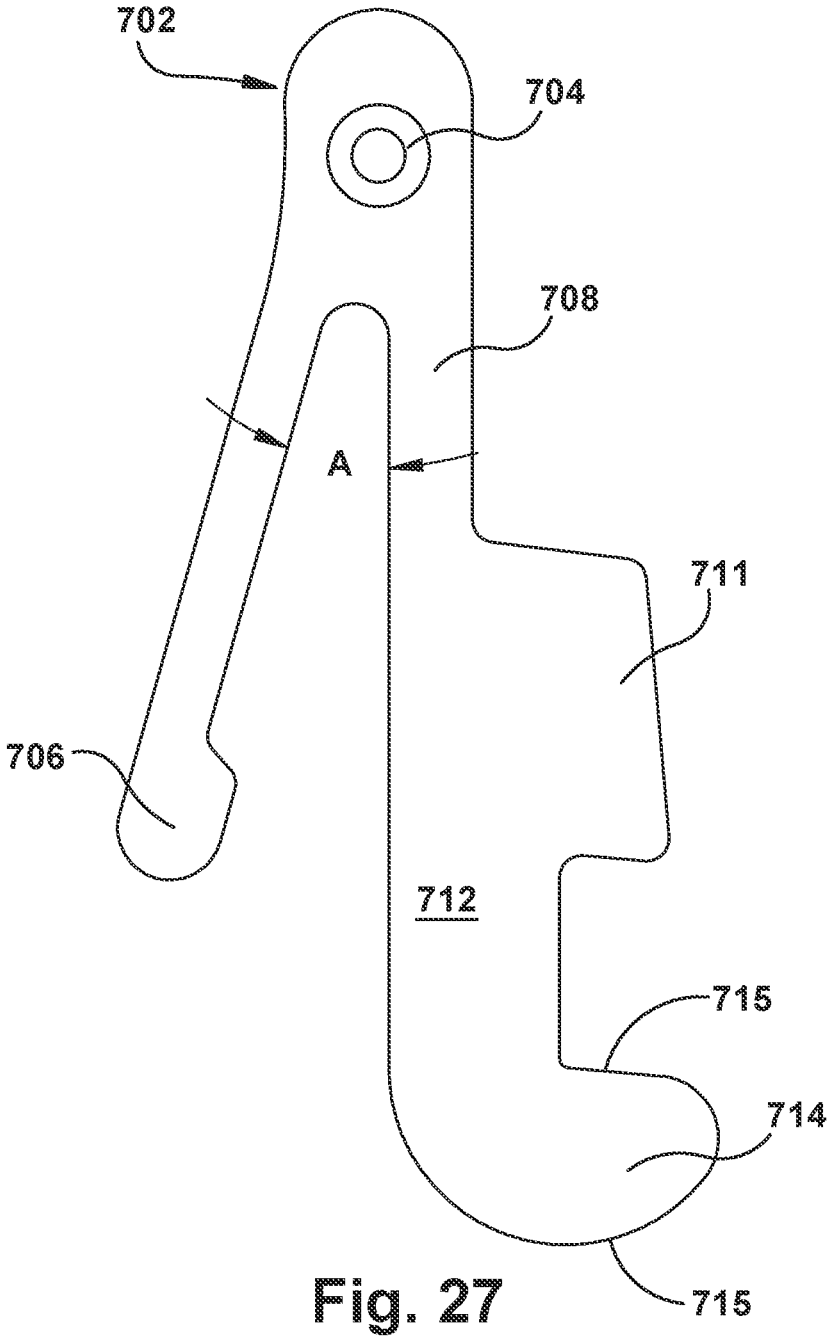
FIG. 27 is a schematic illustration of a latch configuration according to embodiments of the disclosure.

With respect to FIGS. 25-27 in particular FIG. 27, self-biased latch 702 includes a pivot 704 to secure self-biased latch 702 to countertop extension 52, 54. As illustrated pivot 704 may be a screw, rivet, or other suitable fastener to hold self-biased latch 702 in a secure position on countertop extension 52, 54. Self-biased latch 702 includes a fixed arm 706. In certain aspects of the self-biased latch 702, fixed arm 706 is disposed in the latch recess 701. Fixed arm 706 engages and is in a compressed state against an inner most wall of the latch recess 701. Self-biased latch 702 also includes a movable arm 708. Movable arm 708 includes a latching detent 711 and tab 714. Tab 714 includes cam surfaces 715. Cam surfaces 715 are rounded surfaces that enables movable arms 708 to be moved in and out of recess 750 in sidewall 109, as described hereinafter.

Latching tab 711 engages recess 750 inside wall 109 of countertop assembly 10. As illustrated in FIGS. 25 and 26, recess 750 in sidewall 109 of countertop assembly 10 is provided at both side walls 109 of countertop assembly 10 at ends of the countertop assembly 10. As the self-biased latch 702 moves along the inner side wall 109, self-biased latch 702 movable arm 708 slides along side wall until tab 714 engages recess 750. Since cam surfaces 715 are rounded their engagement with recess 750 does not create an interference fit that halts sliding movement of countertop extension 52, 54. Cam surface 715 will ride up and out of recess 750 as movement of 52, 54 continues until latching detent 711 engages recess 750. As illustrated the interference fit of flat portions of recess 750 and latching tab 711 prevent further movement of countertop extension 52, 54 (FIG. 26).

To retract the countertop extension 52, 54, a user engages tabs 714 moving movable arm 718 towards the inner wall of latch recess 701. Thus, movable arms 714 moves latching tab 711 out of recess 750 in sidewall 109. With latching detent 711 moved out of recess 750 in side wall 109, retraction of countertop extension 52, 54 under countertop assembly 10 can be continued.

While not illustrated, if desired, a latch assembly can be provided at opposite ends of countertop extension 52, 54 to retain and engage countertop extension 52, 54 in their retracted position under countertop assembly 10.

Figure 28:
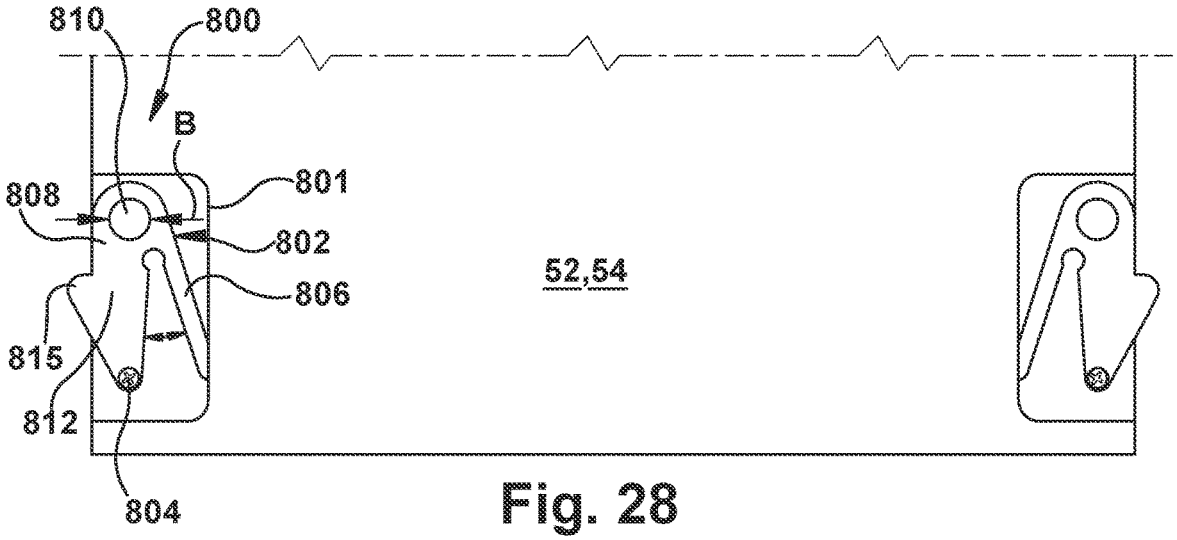
FIG. 28 is a schematic illustration of another latch configuration on the counter extension according to embodiments of the disclosure.
Figure 29:
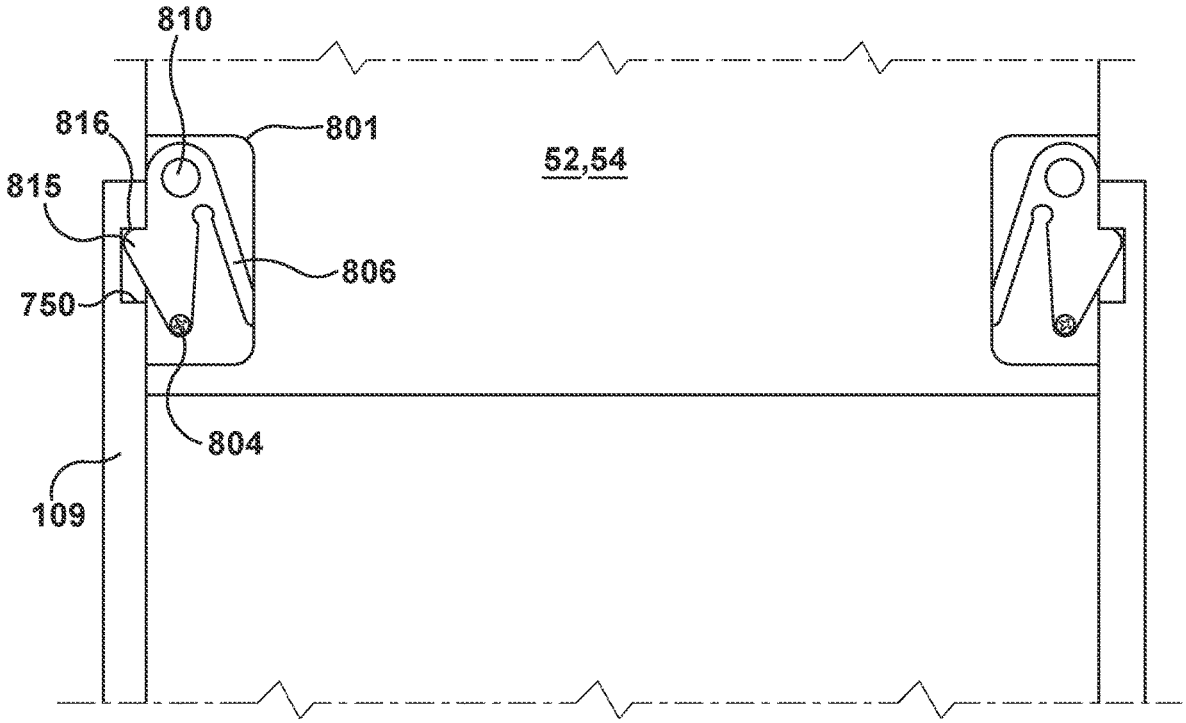
FIG. 29 is a schematic illustration of the another latch configuration of FIG. 28 on the counter extension according to embodiments of the disclosure.
Figure 30:
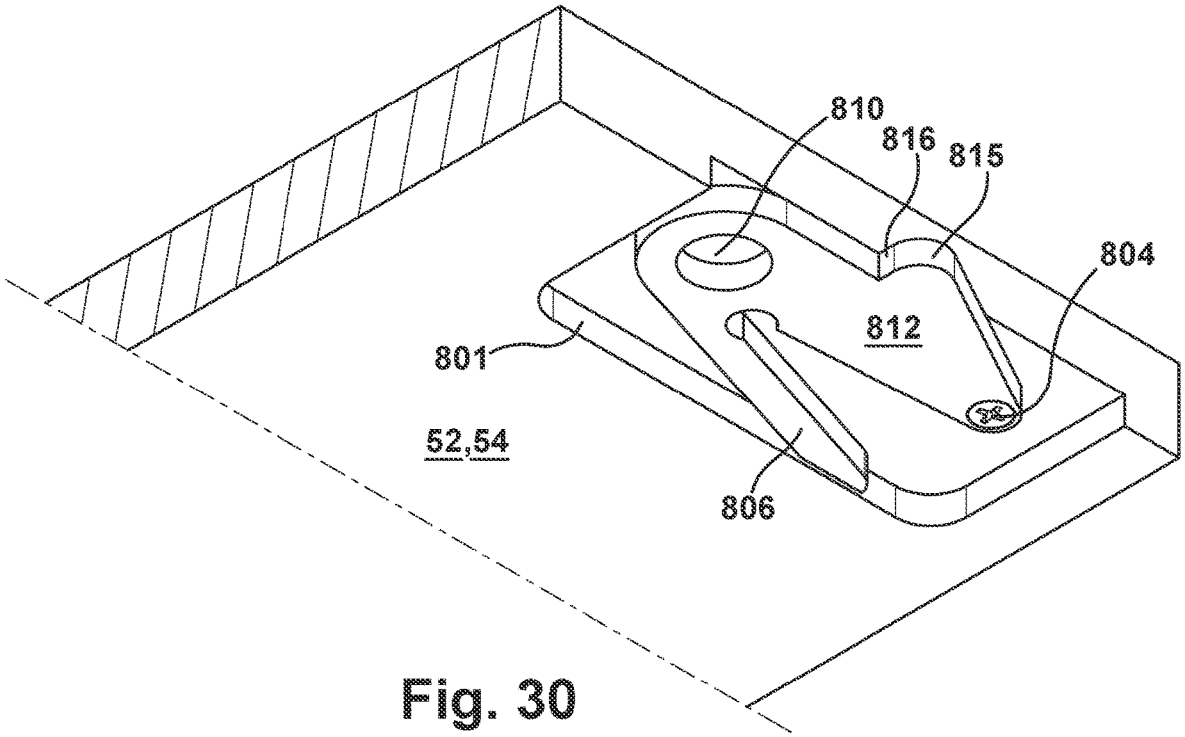
FIG. 30 is a schematic illustration of the another latch configuration of FIG. 28 according to embodiments of the disclosure.

FIGS. 28-30 illustrate another configuration and aspect of a latch assembly 800, as embodied by the invention. In these embodiments of FIGS. 28-30 similar elements are illustrated with similar reference numerals.

As embodied by the latch assembly 800 of FIGS. 28-30, self-biased latch 802 is disposed in latch recess 801 of countertop extension 52, 54. Self-biased latch 802 includes a latch pivot 804, a fixed arm 806, and a movable arm 808.

Movable arm 808 includes an aperture 810 for engaging the self-biased latch 802 and moving self-biased latch 802. Movement of self-biased latch 802 in direction of arrow B causes movable arm 808 to move towards inner wall of latch recess 801. Movable arm 808 includes a latching detent 815. Latching detent 815 can engage recess 750 in side wall 109, as illustrated in FIG. 29. Once latching detent 815 is disposed in recess 750 movement of the countertop extension 52, 54 to its extended position is halted by engagement of stop surface 816 against wall of recess 750, as illustrated in FIG. 29.

To release self-biased latch 802 from its latched position a user engages aperture 810 and moves aperture 810 towards inner side wall of latch recess 710. This movement causes latching detent 815 to be slide out of recess 750 in side wall 109. Further, this movement allows for retraction of the countertop extension 52, 54 back under countertop assembly 10.

As used herein, "approximately" indicates +/-10% of the value, or if a range, of the values stated.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately," as applied to a particular value of a range, applies to both end values and, unless otherwise dependent on the precision of the instrument measuring the value, may indicate +/-10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application and to enable others of ordinary skill in the art to understand the disclosure for various embodiments with various modifications as are suited to the particular use contemplated.

What is claimed is:

1. A convertible furniture article, the convertible furniture article comprising:

a cabinet assembly;

a countertop assembly, the countertop assembly attached to the cabinet assembly;

a female wing;

a male wing; wherein each of the female wing and the male wing are pivotally attached to the countertop assembly; and a rotatable linkage and pivot assembly connected to the countertop assembly and the cabinet assembly, the rotatable linkage and pivot assembly being configured to permit rotation of the countertop assembly approximately 90 degrees from a first position to a second position.

2. The convertible furniture article of claim 1, the countertop assembly and the cabinet assembly each include a first axis and a second axis, the first axis being longer than the second axis, wherein when the first axis of the countertop assembly and the cabinet assembly are aligned, the convertible furniture article is in the first position, and when the countertop assembly and the cabinet assembly are pivoted 90 degrees about the rotatable linkage and pivot assembly the convertible furniture article is in the second position.

3. The convertible furniture article unit of claim 1, wherein the first position is configured to present an island position and the second position is configured to present a table position.

4. The convertible furniture article of claim 1, the convertible furniture article includes at least one pullout assembly at a side of the cabinet assembly.

5. The convertible furniture article of claim 4, wherein the at least one pullout assembly includes at least one shelf.

6. The convertible furniture article of claim 1, the countertop assembly including at least one countertop extension, the at least one countertop extension nested in the countertop assembly.

7. The convertible furniture article of claim 6, wherein the at least one countertop extension nested in the countertop assembly includes two one countertop extensions nested in the countertop assembly, each countertop extension nested in the countertop assembly configured to be slidably extendable from the countertop assembly.

8. The convertible furniture article of claim 6, the convertible furniture article includes at least one pullout assembly at a side of the cabinet assembly, wherein the at least one pullout assembly is configured to support the at least one countertop extension when the at least one countertop extension is in an extended position.

9. The convertible furniture article of claim 8, the convertible furniture article includes two pullout assemblies at each side of the cabinet assembly and two countertop extensions at each side of the cabinet assembly, each of the two pullout assemblies includes at least one shelf, wherein each of the two pullout assemblies is configured to support a respective one of the countertop extensions when the respective countertop extension is in an extended position.

10. The convertible furniture article of claim 8, each of the at least one pullout assembly includes at least one shelf and an extension support pivotally mounted to the at least one shelf, wherein the extension support is pivoted from a position on top of the at least one shelf to a position orthogonal to the at least one shelf, wherein the at least one countertop extension when in an extended position is configured to be supported by the extension support of the pullout assembly.

11. The convertible furniture article of claim 1, further including a wing extension system including a rack and pinion gear system, the rack and pinion gear system mounted to a bottom of the countertop assembly, the female wing and the male wing pivotally connected to the rack and pinion gear system, wherein each of the female wing and the male wing are configured to be pivoted upwards and alignable with the countertop assembly.

12. The convertible furniture article of claim 11, the rack and pinion gear system including at least one geared rack engaged with a geared pinion, each of the female wing and the male wing pivotally connected to one of the at least one geared rack, wherein pivotal movement of one of female wing and the male wing moves the geared rack, and movement of the geared rack rotates the geared pinion.

13. The convertible furniture article of claim 12, the rack and pinion gear system including two sets of two geared racks engaged with a geared pinion, an inner set of geared racks pivotally attached to the male wing and an outer set of geared racks pivotally attached to the female wing, wherein pivotal movement of one of the female wing and the male wing will cause pivotal motion of the other of the female wing and the male wing.

14. The convertible furniture article of claim 11, the rotatable linkage and pivot assembly further including a pivot rod connected to the bottom of the countertop assembly, wherein pivoting of one of the female wing and the male wing will lower the countertop assembly towards the with the cabinet assembly with the pivot rod moving into the cabinet assembly.

15. The convertible furniture article of claim 1, the rotatable linkage and pivot assembly further including a pivot rod connected to the bottom of the countertop assembly.

16. The convertible furniture article of claim 1, the rotatable linkage and pivot assembly further including a cut out in the cabinet assembly and a pivot plate attached to the countertop assembly, the pivot plate configured to move within the cut out in the cabinet assembly.

17. The convertible furniture article of claim 16, the rotatable linkage and pivot assembly further including a stopper mounted on the cut out, and a slot formed in the pivot plate, the stopper configured to be disposed in the slot and moveable only therein, whereby movement of the countertop assembly is limited by interaction of the slot and stopper.

18. The convertible furniture article of claim 1, further including at least one drawer mounted within at least one of the female wing and the male wing.

19. The convertible furniture article of claim 1, further including wheels disposed on the cabinet assembly.

20. The convertible furniture article of claim 1, wherein the female wing includes a cutout, the cutout configured to allow access to the cabinet assembly when the female wing is in a lowered position.

* * * * *